United States Patent [19]

Shimizu et al.

[11] Patent Number: 4,490,450

[45] Date of Patent: Dec. 25, 1984

[54] PHOTOCONDUCTIVE MEMBER

[75] Inventors: Isamu Shimizu; Kozo Arao, both of Yokohama; Eiichi Inoue, Tokyo, all of Japan

[73] Assignee: Canon Kabushiki Kaisha, Tokyo, Japan

[21] Appl. No.: 479,316

[22] Filed: Mar. 28, 1983

[30] Foreign Application Priority Data

| | | | |
|---|---|---|---|
| Mar. 31, 1982 | [JP] | Japan | 57-53600 |
| Mar. 31, 1982 | [JP] | Japan | 57-53601 |
| Mar. 31, 1982 | [JP] | Japan | 57-53604 |
| Mar. 31, 1982 | [JP] | Japan | 57-53605 |
| Mar. 31, 1982 | [JP] | Japan | 57-53607 |
| Mar. 31, 1982 | [JP] | Japan | 57-53608 |
| Mar. 31, 1982 | [JP] | Japan | 57-53611 |
| Mar. 31, 1982 | [JP] | Japan | 57-53612 |

[51] Int. Cl.[3] ..... G03G 5/02; G03G 5/08

[52] U.S. Cl. ..... 430/57; 430/84; 430/85; 430/86; 430/95

[58] Field of Search ..... 430/57, 84, 85, 86, 430/95

[56] References Cited

U.S. PATENT DOCUMENTS

| | | | |
|---|---|---|---|
| 4,147,667 | 4/1979 | Chevallier et al. | 430/84 |
| 4,343,881 | 8/1982 | Sher | 430/57 |
| 4,365,013 | 12/1982 | Ishioka et al. | 430/84 |
| 4,377,628 | 3/1983 | Ishioka et al. | 430/84 |
| 4,378,417 | 3/1983 | Maruyama et al. | 430/84 |

*Primary Examiner*—Mary F. Downey

*Attorney, Agent, or Firm*—Fitzpatrick, Cella, Harper & Scinto

[57] ABSTRACT

A photoconductive member comprises a support for a photoconductive member and an amorphous layer having a layer constitution comprising a first layer region comprising an amorphous material containing silicon atoms and germanium atoms and a second layer region comprising an amorphous material containing silicon atoms and exhibiting photoconductivity, said first and second layer regions being provided successively from the side of said support.

56 Claims, 27 Drawing Figures

PHOTOCONDUCTIVE MEMBER

BACKGROUND OF THE INVENTION

1. Field of the Invention

This invention relates to a photoconductive member having sensitivity to electromagnetic waves such as light (herein used in a broad sense, including ultraviolet rays, visible light, infrared rays, X-rays and gamma-rays).

2. Description of the Prior Art

Photoconductive materials, which constitute photoconductive layers in solid state image pick-up devices, in image forming members for electrophotography in the field of image formation, or in manuscript reading devices, are required to have a high sensitivity, a high SN ratio (Photocurrent ($I_p$)/Dark current ($I_d$)), spectral characteristics matching to those of electromagnetic waves to be irradiated, a rapid response to light, a desired dark resistance value as well as no harm to human bodies during usage. Further, in a solid state image pick-up device, it is also required that the residual image should easily be treated within a predetermined time. In particular, in case of an image forming member for electrophotography to be assembled in an electrophotographic device to be used in an office as office apparatus, the aforesaid harmless characteristic is very important.

From the standpoint as mentioned above, amorphous silicon (hereinafter referred to as a-Si) has recently attracted attention as a photoconductive material. For example, German Laid-Open Patent Publication Nos. 2746967 and 2855718 disclose applications of a-Si for use in image forming members for electrophotography, and German Laid-Open Patent Publication No. 2933411 an application of a-Si for use in a photoconverting reading device.

However, under the present situation, the photoconductive members having photoconductive layers constituted of a-Si are further required to be improved in a balance of overall characteristics including electrical, optical and photoconductive characteristics such as dark resistance value, photosensitivity and response to light, etc., and environmental characteristics during use such as humidity resistance, and further stability with lapse of time.

for instance, when applied in an image forming member for electrophotography, residual potential is frequently observed to remain during use thereof if improvements to higher photosensitivity and higher dark resistance are scheduled to be effected at the same time. When such a photoconductive member is repeatedly used for a long time, there will be caused various inconveniences such as accumulation of fatigues by repeated uses or so called ghost phenomenon wherein residual images are formed, or when it is used at a high speed repeatedly, response is gradually lowered.

Further, a-Si has a relatively smaller absorption coefficient in the wavelength region longer than the longer wavelength region side in the visible light region as compared with that on the shorter wavelength region side in the visible light region, and therefore in matching to the semiconductor laser practically used at the present time or when using a presently available halogen lamp or fluorescent lamp as the light source, there remains room for improvement in the drawback that the light on the longer wavelength side cannot effectively be used.

Besides, when the light irradiated cannot sufficiently be absorbed into the photoconductive layer, but the quantity of the light reaching the support is increased, if the support itself has a high reflectance with respect to the light permeating through the photoconductive layer, there will occur interference due to multiple reflections which may be a cause for formation of "unfocused image".

This effect becomes greater, when the spot irradiated is made smaller in order to enhance resolution, and it is a great problem particularly when using a semiconductor laser as light source.

Thus, it is required in designing of a photoconductive member to make efforts to overcome all of the problems as mentioned above along with the improvement of a-Si materials per se.

In view of the above points, the present invention contemplates the achievement obtained as a result of extensive studies made comprehensively from the standpoints of applicability and utility of a-Si as a photoconductive member for image forming members for electrophotography, solid state image pick-up devices, reading devices, etc. Now, a photoconductive member having an amorphous layer exhibiting photoconductivity, which comprises a-Si, particularly an amorphous material containing at least one of hydrogen atom (H) and halogen atom (X) in a matrix of silicon atoms (hereinafter referred to comprehensively as a-Si(H,X)), so called hydrogenated amorphous silicon, halogenated amorphous silicon or halogen-containing hydrogenated amorphous silicon, said photoconductive member being prepared by designing so as to have a specific structure as described later, is found to exhibit not only practically extremely excellent characteristics but also surpass the photoconductive members of the prior art in substantially all respects, especially markedly excellent characteristics as a photoconductive member for electrophotography. The present invention is based on such finding.

SUMMARY OF THE INVENTION

A primary object of the present invention is to provide a photoconductive member having constantly stable electrical, optical and photoconductive characteristics, which is all-environment type substantially without any limitation as to its use environment and markedly excellent in photosensitive characteristics on the longer wavelength side as well as in light fatigue resistance without causing any deterioration phenomenon after repeated uses and free entirely or substantially from residual potentials observed.

Another object of the present invention is to provide a photoconductive member, which is high in photosensitivity in all the visible light region, particularly excellent in matching to a semiconductor laser and rapid in light response.

A further object of the present invention is to provide a photoconductive member having excellent electrophotographic characteristics, which is sufficiently capable of retaining charges at the time of charging treatment for formation of electrostatic charges to the extent such that a conventional electrophotographic method can be very effectively applied when it is provided for use as an image forming member for electrophotography.

Still another object of the present invention is to provide a photoconductive member for electrophotography capable of providing easily a high quality image which is high in density, clear in halftone and high in resolution.

A still further object of the present invention is to provide a photoconductive member having high photosensitivity and high SN ratio characteristic.

According to the present invention, there is provided a photoconductive member comprising a support for a photoconductive member and an amorphous layer having a layer constitution comprising a first layer region comprising an amorphous material containing silicon atoms and germanium atoms and a second layer region comprising an amorphous material containing silicon atoms and exhibiting photoconductivity, said first and second layer regions being provided successively from the side of said support.

DESCRIPTION OF THE PREFERRED EMBODIMENT

Figure 1:
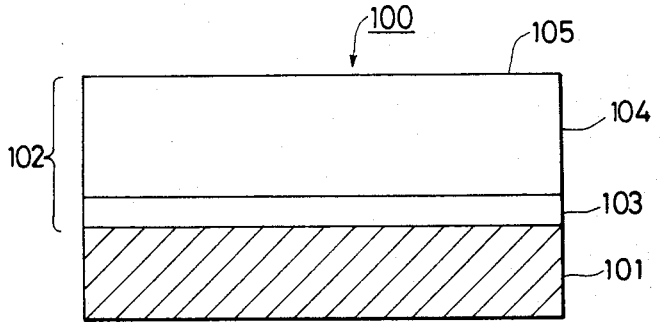
FIG. 1 shows a schematic sectional view for illustration of the layer constitution of a preferred embodiment of the photoconductive member according to the present invention.

Referring now to the drawings, the photoconductive members according to the present invention are to be described in detail below.

FIG. 1 shows a schematic sectional view for illustration of the layer constitution of a first embodiment of the photoconductive member of this invention.

The photoconductive member 100 as shown in FIG. 1 has an amorphous layer 102 on a support 101 for photoconductive member, said amorphous layer 102 having a free surface 105 on one of the end surfaces.

The amorphous layer 102 has a layer constitution comprising a first layer region (G) 103 comprising a-Si (H,X) containing germanium atoms (hereinafter abbreviated as "a-SiGe(H,X)") and a second layer region (S) 104 comprising a-Si(H,X) and having photoconductivity. The first layer region (G) 103 and the second layer region (S) 104 are successively laminated from the side of the support 101. The germanium atoms in the first layer region (G) 103 are contained in said layer region (G) 103 in a distribution continuous and uniform in the direction of the plane substantially parallel to the surface of the support 101, but in a distribution which may either be uniform or ununiform in the direction of layer thickness.

In the present invention, in the second layer region (S) provided on the first layer region (G), no germanium atom is contained. By forming an amorphous layer so as to have such a layer structure, there can be obtained a photoconductive member which is excellent in photosensitivity to the light with wavelengths of the whole region from relatively shorter wavelength to relatively longer wavelength including the visible light region.

Also, since the germanium atoms are continuously distributed throughout the first layer region (G), the light at the longerwavelength side which cannot substantially be absorbed in the second layer region (S) when employing a semiconductor laser, etc. can be absorbed in the first layer region (G) substantially completely, whereby interference due to reflection from the support surface can be prevented.

In the photoconductive member of the present invention, chemical stability can sufficiently be ensured at the laminated interface between the first layer region (G) and the second layer region (S), since each of the amorphous materials constituting respective layer regions has the common constituent of silicon atom.

Alternatively, when the distribution of the germanium atoms is made ununiform in the direction of layer thickness, improvement of the affinity between the first layer region (G) and the second layer region (S) can be effected by making the distribution of germanium atoms in the first layer region (G) such that germanium atoms are continuously distributed throughout the whole layer region and the distribution concentration C of germanium atoms in the direction of layer thickness is changed to be decreased from the support side toward the second layer region (S).

FIGS. 2 through 10 show typical examples of ununiform distribution in the direction of layer thickness of germanium atoms contained in the first layer region (G).

In FIGS. 2 through 10, the axis of abscissa indicates the distribution content C of germanium atoms and the axis of ordinate the layer thickness of the first layer region (G), $t_B$ showing the position of the end surface of the first layer region (G) on the support side and $t_T$ the position of the end surface of the first layer region (G) on the side opposite to the support side. That is, layer formation of the first layer region (G) containing germanium atoms proceeds from the $t_B$ side toward the $t_T$ side.

Figure 2:
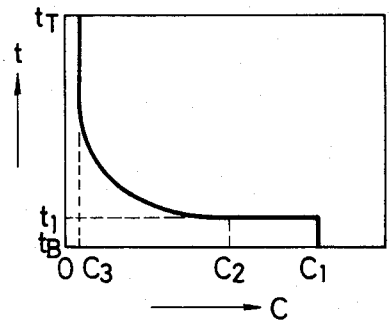
FIGS. 2 through 10 schematic sectional views for illustration of the distribution states of germanium atoms in the amorphous layer, respectively.

In FIG. 2, there is shown a first typical embodiment of the depth profile of germanium atoms in the layer thickness direction contained in the first layer region (G).

In the embodiment as shown in FIG. 2, from the interface position $t_B$ at which the surface, on which the first layer region (G) containing germanium atoms is to be formed, is in contact with the surface of the first layer region (G) to the position $t_1$, the germanium atoms are contained in the first layer region (G), while the distribution concentration C of germanium atoms taking a constant value of $C_1$, which distribution concentration being gradually decreased continuously from the concentration $C_2$ from the position $t_1$ to the interface position $t_T$. At the interface position $t_T$, the concentration of germanium atoms is made $C_3$.

Figure 3:
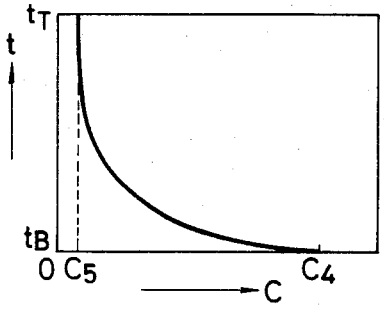

In the embodiment shown in FIG. 3, the distribution concentration C of germanium atoms contained is decreased gradually and continuously from the position $t_B$ to the position $t_T$ from the concentration $C_4$ until it becomes the concentration $C_5$ at the position $t_T$.

Figure 4:
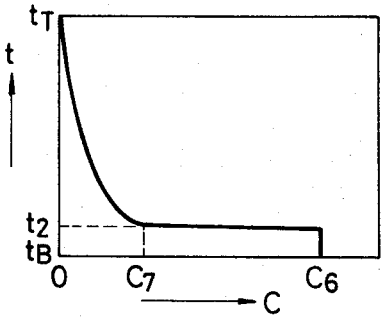

In case of FIG. 4, the distribution concentration C of germanium atoms is made constant as the concentration $C_6$ from the position $t_B$ to the position $t_2$ and gradually continuously decreased from the position $t_2$ to the position $t_T$, and the distribution concentration C is made substantially zero at the position $t_T$ (substantially zero herein means the content less than the detectable limit).

Figure 5:
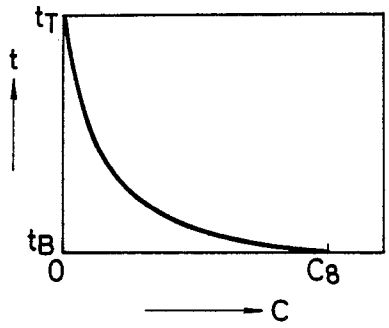

In case of FIG. 5, germanium atoms are decreased gradually and continuously from the position $t_B$ to the position $t_T$ from the concentration $C_8$, until it is made substantially zero at the position $t_T$.

Figure 6:
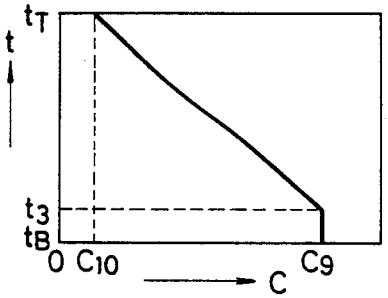

In the embodiment shown in FIG. 6, the distribution concentration C of germanium atoms is constantly $C_9$ between the position $t_B$ and the position $t_3$, and it is made $C_{10}$ at the position $t_T$. Between the position $t_3$ and the position $t_T$, the distribution concentration C is decreased as a first order function from the position $t_3$ to the position $t_T$.

Figure 7:
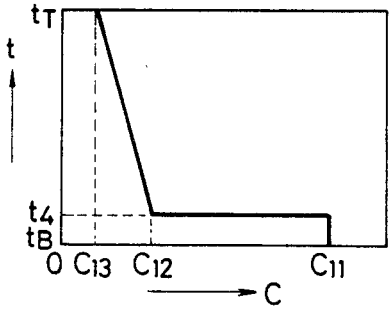

In the embodiment shown in FIG. 7, there is formed a depth profile such that the distribution concentration C takes a constant value of $C_{11}$ from the position $t_B$ to the position $t_4$, and is decreased as a first order function from the concentration $C_{12}$ to the concentration $C_{13}$ from the position $t_4$ to the position $t_T$.

Figure 8:
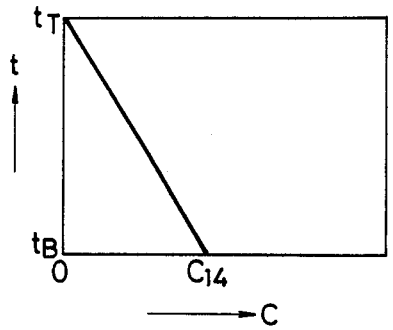

In the embodiment shown in FIG. 8, the distribution concentration C of germanium atoms is decreased as a first order function from the concentration $C_{14}$ to substantially zero from the position $t_B$ to the position $t_T$.

Figure 9:
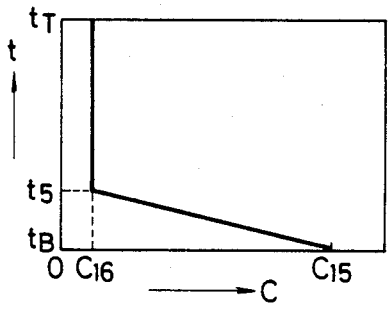

In FIG. 9, there is shown an embodiment, where the distribution concentration C of germanium atoms is decreased as a first order function from the concentration $C_{15}$ to $C_{16}$ from the position $t_B$ to $t_5$ and made constantly at the concentration $C_{16}$ between the position $t_5$ and $t_T$.

Figure 10:
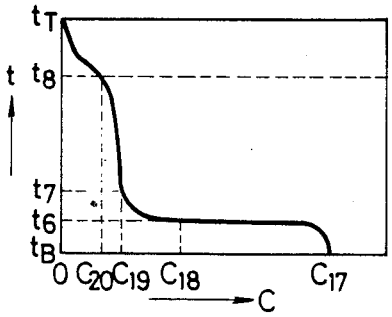

In the embodiment shown in FIG. 10, the distribution concentration C of germanium atoms is at the concentration $C_{17}$ at the position $t_B$, which concentration $C_{17}$ is initially decreased gradually and abruptly near the position $t_6$, until it is made the concentration $C_{18}$ at the position $t_6$.

Between the position $t_6$ and the position $t_7$, the concentration is initially decreased abruptly and thereafter gradually decreased, until it is made the concentration $C_{19}$ at the position $t_7$. Between the position $t_7$ and the position $t_8$, the concentration is decreased very gradually to the concentration $C_{20}$ at the position $t_8$. Between the position $t_8$ and the position $t_T$, the concentration is decreased along the curve having a shape as shown in the Figure from the concentration $C_{20}$ to substantially zero.

As described above about some typical examples of ununiform depth profiles of germanium atoms contained in the first layer region (G) in the direction of the layer thickness, when the depth profile of germanium atoms contained in the first layer region (G) in ununiform in the direction of layer thickness, the first layer region (G) is provided desirably with a depth profile of germanium atoms so as to have a portion enriched in distribution concentration C of germanium atoms on the support side and a portion made considerably lower in concentration C of germanium atoms than that of the support side on the interface $t_T$ side.

That is, the first layer region (G) which constitutes the amorphous layer, when it contains germanium atoms so as to form a ununiform distribution in the direction of layer thickness, may preferably have a localized region (A) containing germanium atoms at a relatively higher concentration on the support side.

The localized region (A), as explained in terms of the symbols shown in FIG. 2 through FIG. 10, may be desirably provided within 5μ from the interface position $t_B$.

The above localized region (A) may be made to be identical with the whole layer region ($L_T$) up to the depth of 5μ thickness, from the interface position $t_B$, or alternatively a part of the layer region ($L_T$).

It may suitably be determined depending on the characteristics required for the amorphous layer to be formed, whether the localized region (A) is made a part or whole of the layer region ($L_T$).

The localized region (A) may be preferably formed according to such a layer formation that the maximum, Cmax of the distribution concentrations of germanium atoms in the layer thickness direction (depth profile values) may preferably be 1000 atomic ppm or more, more preferably 5000 atomic ppm or more, most preferably $1\times10^4$ atomic ppm or more.

That is, according to the present invention, the amorphous layer containing germanium atoms is preferably formed so that the maximum value, Cmax of the distribution concentration may exist within a layer thickness of 5μ from the support side (the layer region within 5μ thickness from $t_B$).

In the present invention, the content of germanium atoms in the first layer region (G), which may suitably be determined as desired so as to achieve effectively the objects of the present invention, may preferably be 1 to $9.5\times10^5$ atomic ppm, more preferably 100 to $8\times10^5$ atomic ppm, most preferably 500 to $7\times10^5$ atomic ppm.

In the photoconductive member of the present invention, the layer thickness of the first layer region (G) and the layer thickness of the second layer region (S) are one of important factors for accomplishing effectively the object of the present invention, and therefore sufficient care should be paid in designing of the photoconductive member so that desirable characteristics may be imparted to the photoconductive member formed.

In the present invention, the layer thickness $T_B$ of the first layer region (G) may preferably be 30 Åto 50μ, more preferably 40 Åto 40μ, most preferably 50 Åto 30μ.

On the other hand, the layer thickness T of the second layer region (S) may be preferably 0.5 to 90μ, more preferably 1 to 80μ, most preferably 2 to 50μ.

The sum of the above layer thicknesses T and $T_B$, namely $(T+T_B)$ may be suitably determined as desired in designing of the layers of the photoconductive member, based on the mutual organic relationship between the characteristics required for both layer regions and the characteristics required for the whole amorphous layer.

In the photoconductive member of the present invention, the numerical range for the above $(T_B+T)$ may generally be from 1 to 100μ, preferably 1 to 80μ, most preferably 2 to 50μ.

In a more preferred embodiment of the present invention, it is preferred to select the numerical values for respective thickness $T_B$ and T as mentioned above so that the relation of preferably $T_B/T\leqq1$ may be satisfied. More preferably, in selection of the numerical values for the thicknesses $T_B$ and T in the above case, the values of $T_B$ and T are preferably be determined so that the relation of more preferably $T_B/T\leqq0.9$, most preferably, $T_B/T\leqq0.8$, may be satisfied.

In the present invention, when the content of germanium atoms in the first layer region (G) is $1\times10^5$ atomic ppm or more, the layer thickness $T_B$ of the first layer region (G) is desirably be made considerably thin, preferably 30μ or less, more preferably 25μ or less, most preferably 20μ or less.

In the present invention, illustrative of halogen atoms (X), which may optionally be incorporated in the first layer region (G) and the second layer region (S) constituting the amorphous layer, are fluorine, chlorine, bromine and iodine, particularly preferably fluorine and chlorine.

In the present invention, the amount of hydrogen atoms (H) or the amount of halogen atoms (X) or the total amount of hydrogen plus halogen atoms (H+X) to be contained in the second layer region (S) constituting the amorphous layer formed may preferably be 1 to 40 atomic %, more preferably 5 to 30 atomic %, most preferably 5 to 25 atomic %.

In the photoconductive member according to the present invention, a substance (C) for controlling the conduction characteristics may be incorporated at least in the first layer region (G) to impart desired conduction characteristics to the first layer region (G).

The substance (C) for controlling the conduction characteristics to be contained in the first layer region (G) may be contained evenly and uniformly within the whole layer region or locally in a part of the layer region.

When the substance (C) for controlling the conduction characteristics is incorporated locally in a part of the first layer region (G) in the present invention, the layer region (PN) containing the aforesaid substance (C) may desirably be provided as an end portion layer region of the first layer region (G). In particular, when the aforesaid layer region (PN) is provided as the end portion layer region on the support side of the first layer region (G), injection of charges of a specific polarity from the support into the amorphous layer can be effectively inhibited by selecting suitably the kind and the content of the aforesaid substance (C) to be contained in said layer region (PN).

In the photoconductive member of the present invention, the substance (C) capable of controlling the conduction characteristics may be incorporated in the first layer region (G) constituting a part of the amorphous layer either evenly throughout the whole region or locally in the direction of layer thickness. Further, alternatively, the aforesaid substance (C) may also be incorporated in the second layer region (S) provided on the first layer region (G). Or, it is also possible to incorporate the aforesaid substance (C) in both of the first layer region (G) and the second layer region (S).

When the aforesaid substance (C) is to be incorporated in the second layer region (S), the kind and the content of the substance (C) to be incorporated in the second layer region (S) as well as its mode of incorporation may be determined suitably depending on the kind and the content of the substance (C) incorporated in the first layer region (G) as well as its mode of incorporation.

In the present invention, when the aforesaid substance (C) is to be incorporated in the second layer region (S), it is preferred that the aforesaid substance (C) may be incorporated within the layer region containing at least the contacted interface with the first layer region (G).

In the present invention, the aforesaid substance (C) may be contained evenly throughout the whole layer region of the second layer region (S) or alternatively uniformly in a part of the layer region.

When the substance (C) for controlling the conduction characteristics is to be incorporated in both of the first layer region (G) and the second layer region (S), it is preferred that the layer region containing the aforesaid substance (C) in the first layer region (G) and the layer region containing the aforesaid substance (C) in the second layer region (S) may be contacted with each other.

The aforesaid substance (C) to be incorporated in the first layer region (G) may be either the same as or different in kind from that in the second layer region (S), and their contents may also be the same or different in respective layer regions.

However, in the present invention, it is preferred that the content of the substance (C) in the first layer region (G) is made sufficiently greater when the same kind of the substance (C) is employed in respective layer regions, or that different kinds of substance (C) with different electrical characteristics are incorporated in desired respective layer regions.

In the present invention, by incorporating the substance (C) for controlling the conduction characteristics at least in the first layer region (G) constituting the amorphous layer, the conduction characteristics of said layer region (PN) can freely be controlled as desired. As such as substance (C), there may be mentioned so called impurities in the field of semiconductors. In the present invention, there may be included P-type impurities giving P-type conduction characteristics and N-type impurities giving N-type conduction characteristics.

More specifically, there may be mentioned as P-type impurities atoms belonging to the group III of the periodic table (the group III atoms), such as B (boron), Al(aluminum), Ga(gallium), In(indium), Tl(thallium), etc., particularly preferably B and Ga.

As N-type impurities, there may be included the atoms belonging to the group V of the periodic table (the group V stoms), such as P(phosphorus), As(arsenic), Sb(antimony), Bi(bismuth), etc., particularly preferably P and As.

In the present invention, the content of the substance (C) in said layer region (PN) may be suitably be selected depending on the conduction characteristics required for said layer region (PN), or when said layer region (PN) is provided in direct contact with the support, depending on the organic relation such as the relation with the characteristics at the contacted interface with the support.

The content of the substance for controlling the conduction characteristics may be suitably selected also with consideration about other layer regions provided in direct contact with said layer region (PN) and the relationship with the characteristics at the contacted interface with said other layer regions.

In the present invention, the content of the substance (C) for controlling the conduction characteristics in the layer region (PN) may be preferably 0.01 to $5\times10^4$ atomic ppm, more preferably 0.5 to $1\times10^4$ atomic ppm, most preferably 1 to $5\times10^3$ atomic ppm.

In the present invention, by making the content of the substance (C) in the layer region (PN) preferably 30 atomic ppm or more, more preferably 50 atomic ppm or more, most preferably 100 atomic ppm or more, in case, for example, when said substance (C) to be incorporated is a P-type impurity, injection of electrons from the support side into the amorphous layer can be effectively inhibited when the free surface of the amorphous layer is subjected to the charging treatment at ⊕ polarity, or in case when the aforesaid substance (C) to be incorporated is a N-type impurity, injection of positive holes from the support side into the amorphous layer can be effectively inhibited when the free surface of the amorphous layer is subjected to the charging treatment at ⊖ polarity.

In the above cases, as described previously, the layer region (Z) excluding the aforesaid layer region (PN) may contain a substance (C) with a conduction type of a polarity different from that of the substance (C) contained in the layer region (PN), or it may contain substance (C) with a conduction type of the same polarity as that of the substance (C) in the layer region (PN) in an amount by far smaller than the practical amount to be contained in the layer region (PN).

In such a case, the content of the substance (C) for controlling the conduction characteristics to be contained in the aforesaid layer region (Z), which may suitably be determined as desired depending on the polarity and the content of the aforesaid substance (C) contained in the aforesaid layer region (PN), may be preferably 0.001 to 1000 atomic ppm, more preferably 0.05 to 500 atomic ppm, most preferably 0.1 to 200 atomic ppm.

In the present invention, when the same kind of the substance (C) is contained in the layer region (PN) and the layer region (Z), the content in the layer region (Z) may preferably be 30 atomic ppm or less.

In the present invention, by providing in the amorphous layer a layer region containing a substance ($C_1$) for controlling the conduction characteristics having a conduction type of one polarity and a layer region containing a substance ($C_2$) for controlling the conduction characteristics having a conduction type of the other polarity in direct contact with each other, there can also be provided a so called depletion layer at said contacted region.

In short, a depletion layer can be provided in the amorphous layer, for example, by providing a layer region (P) containing the aforesaid P-type impurity and a layer region (N) containing the aforesaid N-type impurity so as to be directly contacted with each other thereby to form a so called P-N junction.

In the photoconductive member of the present invention, for the purpose of improvements to higher photosensitivity, higher dark resistance and, further, improvement of adhesion between the support and the amorphous layer, it is desirable to incorporate oxygen atoms in the amorphous layer.

The oxygen atoms contained in the amorphous layer may be contained either evenly throughout the whole layer region of the amorphous layer or locally only in a part of the layer region of the amorphous layer.

The oxygen atoms may be distributed in the direction of layer thickness of the amorphous layer such that the distribution concentration C(O) may be either uniform or ununiform similarly to the distribution state of germanium atoms as described by referring to FIGS. 2 through 10.

In short, the distribution of oxygen atoms when the distribution concentration C(O) in the direction of layer thickness is ununiform may be explained similarly as in case of the germanium atoms by using FIGS. 2 through 10.

In the present invention, the layer region (O) constituting the amorphous layer, when improvements of photosensitivity and dark resistance are primarily intended, is provided so as to occupy the whole layer region of the amorphous layer region on the support side of the amorphous layer when reinforcement of adhesion between the support the amorphous layer is primarily intended.

In the former case, the content of oxygen atoms in the layer region (O) may be desirably made relatively smaller in order to maintain high photosensitivity, while in the latter case the content may be desirably made relatively large for ensuring reinforcement of adhesion with the support.

Also, for the purpose of accomplishing both of the former and latter objects at the same time, oxygen atoms may be distributed in the layer region (O) so that they may be distributed in a relatively higher concentration on the support side, and in a relatively lower concentration on the free surface side of the amorphous layer, or no oxygen atom may be positively included in the layer region on the free surface side of the amorphous layer.

The content of oxygen atoms to be contained in the layer region (O) may be suitably selected depending on the characteristics required for the layer region (O) per se or, when said layer region (O) is provided in direct contact with the support, depending on the organic relationship such as the relation with the characteristics at the contacted interface with said support, and others.

When another layer region is to be provided in direct contact with said layer region (O), the content of oxygen atoms may be suitably selected also with considerations about the characteristics of said another layer region and the relation with the characteristics of the contacted interface with said another layer region.

The content of oxygen atoms in the layer region (O), which may suitably be determined as desired depending on the characteristics required for the photoconductive member to be formed, may be preferably 0.001 to 50 atomic %, more preferably 0.002 to 40 atomic %, most preferably 0.003 to 30 atomic %.

In the present invention, when the layer region (O) occupies the whole region of the amorphous layer or when, although it does not occupy the whole layer region, the layer thickness $T_O$ of the layer region (O) is sufficiently large relative to the layer thickness T of the amorphous layer, the upper limit of the content of oxygen atoms in the layer region (O) is desirably be sufficiently smaller than the aforesaid value.

That is, in such a case when the ratio of the layer thickness $T_O$ of the layer region (O) relative to the layer thickness T of the amorphous layer is 2/5 or higher, the upper limit of the content of oxygen atoms in the layer region (O) may preferably be 30 atomic % or less, more preferably 20 atomic % or less, most preferably 10 atomic % or less.

In the present invention, the layer region (O) constituting the amorphous layer may desirably be provided so as to have a localized region (B) containing oxygen atoms in a relatively higher concentration on the support side as described above, and in this case, adhesion between the support and the amorphous layer can be further improved.

The localized region (B), as explained in terms of the symbols shown in FIG. 2 through FIG. 10 may be desirably provided within 5μ from the interface position $t_B$.

In the present invention, the above localized region (B) may be made to be identical with the whole layer region ($L_T$) up to the depth of 5μ thickness from the interface position $t_B$, or alternatively a part of the layer region ($L_T$).

It may suitably be determined depending on the characteristics required for the amorphous layer to be formed, whether the localized region (B) is made a part or whole of the layer region ($L_T$).

The localized region (B) may preferably be formed according to such a layer formation that the maximum, Cmax of the distribution concentration of oxygen atoms in the layer thickness direction may preferably be 500 atomic ppm or more, more preferably 800 atomic ppm or more, most preferably 1000 atomic ppm or more.

That is, the layer region (O) may desirably be formed so that the maximum value, Cmax of the distribution concentration within a layer thickness of 5μ from the support side (the layer region within 5μ thickness from $t_B$).

In the present invention, formation of a first layer region (G) comprising a-SiGe(H, X) may be conducted according to the vacuum deposition method utilizing discharging phenomenon, such as glow discharge method, sputtering method or ion-plating method. For example, for formation of the first layer region (G) comprising a-SiGe(H, X) according to the glow discharge method, the basic procedure comprises introducing a starting gas capable of supplying silicon atoms (Si) and a starting gas capable of supplying germanium atoms (Ge) together with, if necessary, a starting gas for introduction of hydrogen atoms (H) or/and a starting gas for introduction of halogen atoms (X) into the deposition chamber which can be internally brought to a reduced pressure, and exciting glow discharge in said deposition chamber, thereby forming a layer comprising a-SiGe(H, X) on the surface of a support set a predetermined position. For formation of the layer according to the sputtering method, when effecting sputtering by use of two sheets of a target constituted of Si and a target constituted of Ge or one sheet of a target containing a mixture of Si and Ge, in an atmosphere of, for example, an inert gas such as Ar, He, etc. or a gas mixture based on these gases, a gas for introduction of hydrogen atoms (H) or/and halogen atoms (X) may be optionally introduced into the deposition chamber for sputtering.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency for supplying Si.

As the substances which can be starting gases for Ge supply, there may be included gaseous or gasifiable hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$ and the like as effective ones. In particular, for easiness in handling during layer forming operations and efficiency in supplying, $GeH_4$, $Ge_2H_6$ and $Ge_3H_8$ are preferred.

Effective starting gases for introduction of halogen atoms to be used in the present invention may include a large number of halogen compounds, including gaseous or gasifiable halogen compounds, as exemplified by halogen gases, halides, interhalogen compounds, or silane derivatives substituted with halogens.

Further, there may also be included gaseous or gasifiable hydrogenated silicon compounds containing halogen atoms constituted of silicon atoms and halogen atoms as constituent elements as effective ones in the present invention.

Typical examples of halogen compounds preferably used in the present invention may include halogen gases such as of fluorine, chlorine, bromine or idoine, interhalogen compounds such as BrF, ClF, $ClF_3$, $BrF_5$, $BrF_3$, $IF_3$, $IF_7$, ICl, IBr, etc.

As the silicon compounds containing halogen atoms, namely so called silane derivatives substituted with halogens, there may preferably be employed silicon halides such as $SiF_4$, $Si_2F_6$, $SiCl_4$, $SiBr_4$ and the like.

When the characteristic photoductive member of the present invention is to be formed according to the glow discharge method by employment of such a silicon compound containing halogen atoms, it is possible to form a first layer region (G) comprising a-SiGe containing halogen atoms on a certain support without use of a hydrogenated silicon gas as the starting material capable of supplying Si together with a starting gas for Ge supply.

For formation of a first layer region (G) containing halogen atoms according to the glow discharge method, the basic procedure comprises, for example, introducing a silicon halide gas as the starting gas for Si supply, a hydrogenated germanium as the starting gas for Ge supply and a gas such as Ar, $H_2$, He, etc. at a predetermined mixing ratio and gas flow rates into a deposition chamber for formation of the first layer region (G) and exciting glow discharging therein to form a plasma atmosphere of these gases, whereby the first layer region (G) can be formed on a certain support. For the purpose of controlling more easily the ratio of hydrogen atoms introduced, these gases may further be admixed at a desired level with a gas of a silicon compound containing hydrogen atoms.

Also, the respective gases may be used not only as single species but as a mixture of plural species.

For formation of a first layer region (G) comprising a-SiGe(H, X) according to the reactive sputtering method or the ion plating method, for example, in case of the sputtering method, sputtering may be effected by use of two sheets of a target of Si and a target of Ge or one sheet of a target comprising Si and Ge in a certain gas plasma atmosphere; or in case of the ion plating method, a polycrystalline silicon or a single crystalline silicon and a polycrystalline germanium or a single crystalline germanium are each placed as vapor sources in a vapor deposition boat and these vapor sources are vaporized by heating according to the resistance heating method or the electron beam method (EB method), and the resultant flying vaporized product is permitted to pass through the gas plasma atmosphere.

During this procedure, in either of the sputtering method or the ion plating method, introduction of halogen atoms into the layer formed may be effected by introducing a gas of a halogen compound or a silicon compound containing halogen atoms as described above into the deposition chamber and forming a plasma atmosphere of said gas.

Also, for introduction of hydrogen atoms, a starting gas for introduction of hydrogen atoms, such as $H_2$, or a gas of silanes or/and hydrogenated germanium such as those mentioned above may be introduced into the deposition chamber and a plasma atmosphere of said gas may be formed therein.

In the present invention, as the starting gas for introduction of halogen atoms, the halogen compounds or silicon compounds containing halogens as mentioned above can effectively be used. In addition, it is also possible to use a gaseous or gasifiable halide containing hydrogen atom as one of the constituents such as hydrogen halide, including HF, HCl, HBr, HI and the like, halo-substituted hydrogenated silicon, including $SiH_2F_2$, $SiH_2I_2$, $SiH_2Cl_2$, $SiHCl_3$, $SiH_2Br_2$, $SiHBr_3$ and the like, and hydrogenated germanium halides, including $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, $GeH_3I$ and the like; and gaseous or gasifiable germanium halides such as $GeF_4$, $GeCl_4$, $GeBr_4$, $GeI_4$, $GeF_2$, $GeCl_2$, $GeBr_2$, $GeI_2$, and so on as an effective starting material for formation of a first amorphous layer region (G).

Among these substances, halides containing hydrogen atom, which can introduce hydrogen atoms very effective for controlling electrical or photoelectric characteristics into the layer during formation of the first layer region (G) simultaneously with introduction of halogen atoms, can preferably be used as the starting material for introduction of halogen atoms.

For incorporation of hydrogen atoms structurally into the first layer region (G), other than the above method, $H_2$ or hydrogenated silicon, including $SiH_4$, $Si_2H_6$, $Si_3H_8$ and $Si_4H_{10}$ and the like and germanium or a germanium compound for supplying Ge, or alternatively a hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$ and the like and silicon or a silicon compound for supplying Si may be permitted to be copresent in a deposition chamber, wherein discharging is excited.

In preferred embodiments of this invention, the amount of hydrogen atoms (H) or halogen atoms (X) incorporated in the first layer region (G) constituting the amorphous layer formed, or total amount of hydrogen atoms and halogen atoms (H+X), may be preferably 0.01 to 40 atomic %, more preferably 0.05 to 30 atomic %, most preferably 0.1 to 25 atomic %.

For controlling the amounts of hydrogen atoms (H) or/and halogen atoms (X) in the first layer region (G), for example, the support temperature or/and the amounts of the starting materials for incorporation of hydrogen atoms (H) or halogen atoms (X) to be introduced into the deposition device system or the discharging power may be controlled.

In the present invention, for formation of the second layer region (S) comprising a-Si(H, X), the starting materials selected from among the starting materials (I) for formation of the first layer region (G) as described above except for the starting material as the starting gas for Ge supply [that is, the starting materials (II) for formation of the second layer region (S)] may be employed, following the same method and conditions in case of formation of the first layer region (G).

That is, in the present invention, formation of a second layer region (S) comprising a-Si(H, X) may be conducted according to the vacuum deposition method utilizing discharging phenomenon, such as glow discharge method, sputtering method or ion-plating method. For example, for formation of the second layer region (S) comprising a-Si(H, X) according to the glow discharge method, the basic procedure comprises introducing a starting gas capable of supplying silicon atoms (Si) together with, if necessary, a starting gas for introduction of hydrogen atoms or/and halogen atoms into the deposition chamber which can be internally brought to a reduced pressure, and exciting glow discharge in said deposition chamber, thereby forming a layer comprising a-Si(H, X) on the surface of a support set a predetermined position. For formation of the layer according to the sputtering method, when effecting sputtering by use of a target constituted of Si in an atmosphere of, for example, an inert gas such as Ar, He, etc. or a gas mixture based on these gases, a gas for introduction of hydrogen atoms (H) or/and halogen atoms (X) may be introduced into the deposition chamber for sputtering.

For formation of a layer region (PN) containing a substance (C) for controlling the conduction characteristics, for example, the group III atoms or the group V atoms by introducing structurally the substance (C) into the layer region constituting the amorphous layer, a starting material for introduction of the group III atoms or a starting material for introduction of the group V atoms may be introduced under gaseous state into the deposition chamber together with other starting materials for forming the amorphous layer. As such starting materials for introduction of the group III atoms, there may preferably be used gaseous or at least gasifiable compounds under the layer forming conditions. Typical examples of such starting materials for introduction of the group III atoms may include hydrogenated boron such as $B_2H_6$, $B_4H_{10}$, $B_5H_9$, $B_5H_{11}$, $B_6H_{10}$, $B_6H_{12}$, $B_6H_{14}$ and the like, boron halides such as $BF_3$, $BCl_3$, $BBr_3$ and the like for introduction of boron atoms. In addition, there may also be employed $AlCl_3$, $GaCl_3$, $Ga(CH_3)_3$, $InCl_3$, $TlCl_3$, etc.

As the starting material for introduction of the group V atoms to be effectively used in the present invention, there may be mentioned hydrogenated phosphorus such as $PH_3$, $P_2H_4$ and the like, phosphorus halides such as $PH_4I$, $PF_3$, $PF_5$, $PCl_3$, $PCl_5$, $PBr_3$, $PBr_5$, $PI_3$ and the like for introduction of phosphorus atoms. In addition, there may also be included $AsH_3$, $AsF_3$, $AsCl_3$, $AsBr_3$, $AsF_5$, $SbH_3$, $SbF_3$, $SbF_5$, $SbCl_3$, $SbCl_5$, $SiH_3$, $SiCl_3$, $BiBr_3$, etc. also as effective starting materials for introduction of the group V atoms.

For formation of the layer region (O) containing oxygen atoms in the amorphous layer, a starting material for introduction of oxygen atoms may be used together with the starting material for formation of the amorphous layer as mentioned above during formation of the layer and may be incorporated in the layer while controlling their amounts. When the glow discharge method is to be employed for formation of the layer region (O), a starting material for introduction of oxygen atoms may be added to the starting material selected as desired from those for formation of the amorphous layer as mentioned above. As such a starting material for introduction of oxygen atoms, there may be employed most of gaseous or gasifiable substances containing at least oxygen atoms as constituent atoms.

For example, there may be employed a mixture of a starting gas containing silicon atoms (Si) as constituent atoms, a starting gas containing oxygen atoms (O) as constituent atoms and optionally a starting gas containing hydrogen atoms (H) or/and halogen atoms (X) as constituent atoms at a desired mixing ratio; a mixture of a starting gas containing silicon atoms (Si) as constituent atoms and a starting gas containing oxygen atoms (O) and hydrogen atoms (H) as constituent atoms also at a desired mixing ratio; or a mixture of a starting gas containing silicon atoms (Si) as constituent atoms and a starting gas containing the three atoms of silicon atoms (Si), oxygen atoms (O) and hydrogen atoms (H) as constituent atoms.

Alternatively, there may also be employed a mixture of a starting gas containing silicon atoms (Si) and hydrogen atoms (H) as constituent atoms and a starting gas containing oxygen atoms (O) as constituent atoms.

More specifically, there may be mentioned, for example, oxygen ($O_2$), ozone ($O_3$), nitrogen monooxide (NO), nitrogen dioxide ($NO_2$), dinitrogen monooxide ($N_2O$), dinitrogen trioxide ($N_2O_3$), dinitrogen tetraoxide ($N_2O_4$), dinitrogen pentaoxide ($N_2O_5$), nitrogen trioxide ($NO_3$), and lower siloxanes containing silicon atoms (Si), oxygen atoms (O) and hydrogen atoms (H) as constituent atoms such as disiloxane $H_3SiOSiH_3$, trisiloxane $H_3SiOSiH_2OSiH_3$, and the like.

For formation of the layer region (O) containing oxygen atoms according to the sputtering method, a single crystalline or polycrystalline Si wafer or $SiO_2$ wafer or a wafer containing Si and $SiO_2$ mixed therein may be employed and sputtering of these wafers may be conducted in various gas atmosphere.

For example, when Si wafer is employed as the target, a starting gas for introduction of oxygen atoms optionally together with a starting gas for introduction of hydrogen atoms or/and halogen atoms, which may optionally be diluted with a diluting gas, may be introduced into a deposition chamber for sputtering to form gas plasma of these gases, in which sputtering with the aforesaid Si wafer may be effected.

Alternatively, by use of separate targets of Si and $SiO_2$ or one sheet of a target containing Si and $SiO_2$ mixed therein, sputtering may be effected in an atmosphere of a diluting gas as a gas for sputtering or in a gas atmosphere containing at least hydrogen atoms (H) or/and halogen atoms (X) as constituent atoms. As the starting gas for introduction of oxygen atoms, there may be employed the starting gases shown as examples in the glow discharge method previously described also as effective gases in case of sputtering.

In the present invention, when providing a layer region (O) containing oxygen atoms during formation of the amorphous layer, formation of the layer region (O) having a desired distribution state (depth profile) of oxygen atoms in the direction of layer thickness formed by varying the distribution concentration C(O) of oxygen atoms contained in said layer region (O) may be conducted in case of glow discharge by introducing a starting gas for introduction of oxygen atoms into a deposition chamber, while varying suitably its gas flow rate according to a desired change rate curve. For example, by the manual method or any other method conventionally used such as an externally driven motor, etc., the opening of a certain needle valve provided in the course of the gas flow channel system may be gradually varied. During this procedure, the rate of variation in the gas flow rate is not necessarily required to be linear, but the gas flow rate may be controlled according to a variation rate curve previously designed by means of, for example, a microcomputer to give a deisred content curve.

In case when the layer region (O) is formed by the sputtering method, a first method for formation of a desired distribution state (depth profile) of oxygen atoms in the direction of layer thickness by varying the distribution concentration C(O) of oxygen atoms in the direction of layer thickness may be performed similarly as in case of the glow discharge method by employing a starting material for introduction of oxygen atoms under gaseous state and varying suitably as desired the gas flow rate of said gas when introduced into the deposition chamber.

Secondly, formation of such a depth profile can also be achieved by previously changing the composition of a target for sputtering. For example, when a target comprising a mixture of Si and $SiO_2$ is to be used, the mixing ratio of Si to $SiO_2$ may be varied in the direction of layer thickness of the target.

The support to be used in the present invention may be either electroconductive or insulating. As the electroconductive material, there may be mentioned metals such as NiCr, stainless steel, Al, Cr, Mo, Au, Nb, Ta, V, Ti, Pt, Pd etc. or alloys thereof.

As insulating supports, there may usually be used films or sheets of synthetic resins, including polyester, phlyethylene, polycarbonate, cellulose acetate, polypropylene, polyvinyl chloride, polyvinylidene chloride, polystyrene, polyamide, etc., glasses, ceramics, papers and so on. These insulating supports should preferably have at least one surface subjected to electroconductive treatment, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($IN_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The support may be shaped in any form such as cylinders, belts, plates or others, and its form may be determined as desired. For example, when the photoconductive member 100 in FIG. 1 is to be used as an image forming member for electrophotography, it may desirably be formed into an endless belt or a cylinder for use in continuous high speed copying. The support may have a thickness, which is conveniently determined so that a photoconductive member as desired may be formed. When the photoconductive member is required to have a flexibility, the support is made as thin as possible, so far as the function of a support can be exhibited. However, in such a case, the thickness is generally 10$\mu$ or more from the points of fabrication and handling of the support as well as its mechanical strength.

Next, an example of the process for producing the photoconductive member of this invention is to be briefly described.

Figure 11:
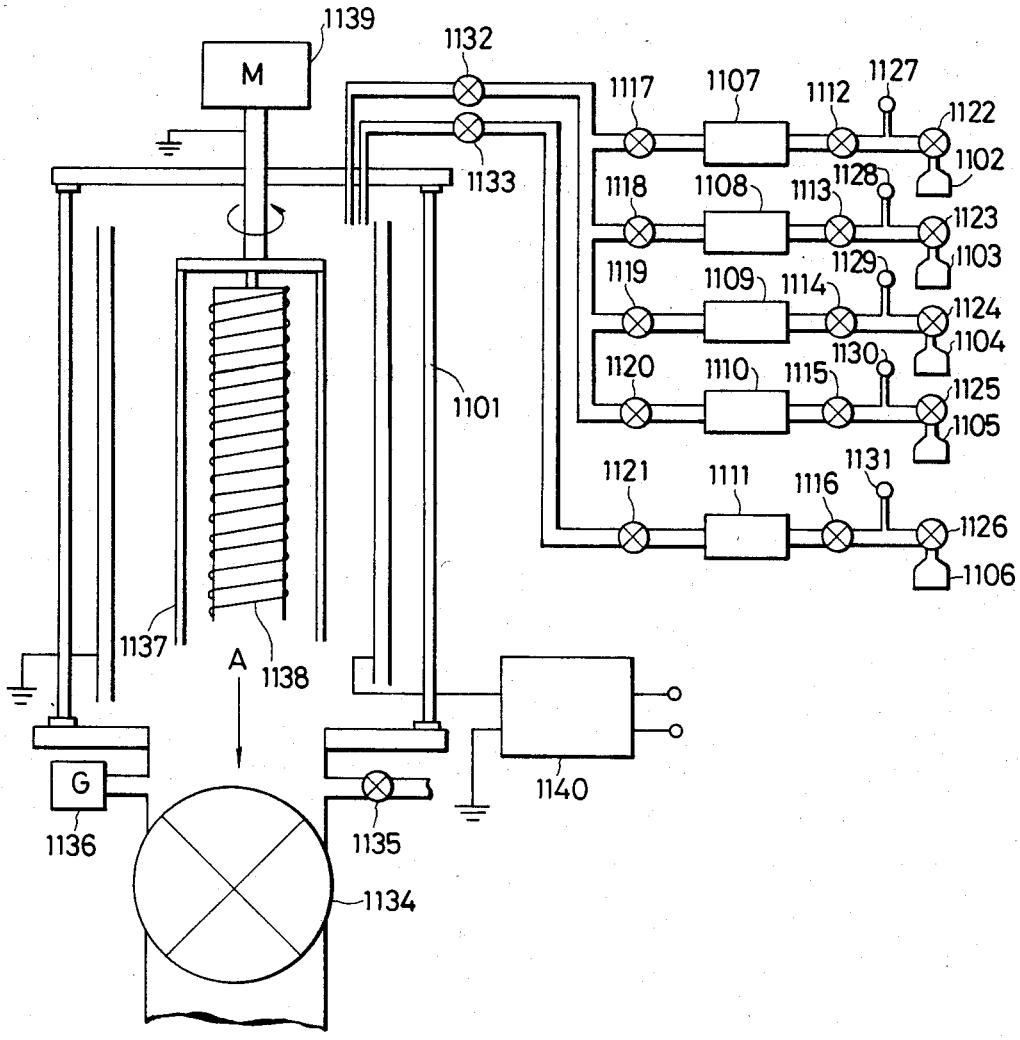
FIG. 11 a schematic flow chart for illustration of the device used in the present invention.

FIG. 11 shows one example of a device for producing a photoconductive member.

In the gas bombs 1102–1106 there are hermetically contained starting gases for formation of the photoconductive member of the present invention. For example, 1102 is a bomb containing $SiH_4$ gas (purity: 99.999%) diluted with He (hereinafter abbreviated as "$SiH_4$/He"), 1103 is a bomb containing $GeH_4$gas (purity: 99.999%) diluted with He (hereinafter abbreviated as "$GeH_4$He"), 1104 is a bomb containing $SiF_4$ gas (purity: 99.99%) diluted with He (hereinafter abbreviated as "$SiF_4$/He"), 1105 is a He gas bomb (purity: 99.999%) and 1106 is a $H_2$ gas bomb (purity: 99.999%).

For allowing these gases to flow into the reaction chamber 1101, on confirmation of the valves 1122–1126 of the gas bombs 1102–1106 and the leak valve 1135 to be closed, and the inflow valves 1112–1116, the outflow valves 1117–1121 and the auxiliary valves 1132, 1133 to be opened, the main valve 1134 is first opened to evacuate the reaction chamber 1101 and the gas pipelines. As the next step, when the reading on the vacuum indicator 1136 becomes about $5\times10^{-6}$ Torr, the auxiliary valves 1132, 1133 and the outflow valves 1117–1121 are closed.

Referring now to an example of forming an amorphous layer on the cylindrical substrate 1137, $SiH_4$/He gas from the gas bomb 1102 and $GeH_4$/He gas from the gas bomb 1103 are permitted to flow into the mass-flow controllers 1107 and 1108 by opening the valves 1122, 1123, respectively, and controlling the pressures at the outlet pressure gauges 1127, 1128 to 1 $Kg/cm^2$ and opening gradually the inflow valves 1112, 1113. Subsequently, the outflow valves 1117, 1118 and the auxiliary valve 1132 are gradually opened to permit respective gases to flow into the reaction chamber 1101. The outflow valves 1117, 1118 are controlled so that the flow rate ratio of $SiH_4$/He to $GeH_4$/He may have a desired value and opening of the main valve 1134 is also controlled while watching the reading on the vacuum indicator 1136 so that the pressure in the reaction chamber may reach a desired value. And, after confirming that the temperature of the substrate cylinder 1137 is set at 50°–400° C. by the heater 1138, the power source 1140 is set at a desired power to excite glow discharge in the reaction chamber 1101, thereby incorporating germanium atoms in the layer formed.

As described above, glow discharging is maintained for a desired period of time until a first layer region (G) is formed on the substrate 1137. At the stage when the first layer region (G) is formed to a desired layer thickness, following the same conditions and the procedure as in formation of the first layer region except for closing completely the outflow valve 1118 and changing the discharging conditions, if desired, glow discharging is maintained for a desired period of time, whereby a second layer region (S) containing substantially no germanium atom can be formed on the first layer region (G).

For making the distribution state of germanium atoms to be contained in the first layer region (G) ununiform, at the stage when preliminary operations have been completed according to a predetermined procedure, glow discharging may be excited simultaneously with performing the procedure to change the flow rate of $GeH_4$/He gas in accordance with a previously designed change rate curve by gradually changing the opening of the valve 1118 manually or by means of an externally driven motor, whereby the distribution concentration of germanium atoms contained in the layer formed can be controlled.

For incorporating oxygen atoms structurally into the first layer region (G), the second layer region (S) or both thereof, a starting gas for introduction of oxygen atoms, for example, NO may be introduced in addition to the gases as described above during formation of respective layer regions.

Also, for making ununiform the distribution state of oxygen atoms in the direction of layer thickness in the layer region, there may be employed the same method as described above in case of germanium atoms.

For incorporation of a substance for controlling the conduction characteristics in the first layer region (G), the second layer region (S) or both thereof, a gas such as $B_2H_6$, $PH_3$ etc. may be added into the gases to be introduced into the deposition chamber 1101 during formation of respective layer regions.

In the course of layer formation, for the purpose of effecting uniform layer formation, the substrate 1137 may desirably be rotated at a constant speed by a motor 1139.

The photoconductive member of the present invention designed to have layer constitution as described above can overcome all of the problems as mentioned above and exhibit very excellent electrical, optical, photoconductive characteristics, dielectric strength and good environmental characteristics in use.

In particular, when it is applied as an image forming member for electrophotography, it is free from any influence of residual potential on image formation at all, being stable in its electrical properties with high sensitivity and having high SN ratio as well as excellent light fatigue resistance and repeated usage characteristics, whereby it is possible to obtain stably and repeatedly images of high quality with high concentration, clear halftone and high resolution.

Further, the photoconductive member of the present invention is high in photosensitivity in the entire visible light region, particularly excellent in matching to a semiconductor laser and rapid in light response.

EXAMPLE 1

By means of the preparation device as shown in FIG. 11, layers were formed on a cylindrical aluminum substrate under the conditions as indicated in Table 1A to obtain an image forming member for electrophotography.

The image forming member thus obtained was set in a charging-exposure experimental device, subjected to corona charging at ⊖5.0 kV for 0.3 sec, followed immediately by irradiation of a light image. As the light source, a tungsten lamp was employed and irradiation was effected at 2 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper while conducting corona charging at ⊖5.0 KV, there was obtained a clear image with high density which was excellent in resolution and good in halftone reproducibility.

EXAMPLE 2

By means of the preparation device as shown in FIG. 11, layers were formed in the same manner as in Example 1 except that the conditions were changed to those as shown in Table 2A to obtain an image forming member for electrophotography.

Using the thus obtained image forming member, images were formed on transfer papers according to the same procedure and under the same conditions as in Example 1 except that the polarity in corona charging and the charged polarity of the developer were made opposite to those in Example 1, respectively, to obtain a very clear image quality.

EXAMPLE 3

By means of the preparation device as shown in FIG. 11, layers were formed in the same manner as in Example 1 except that the conditions were changed to those as shown in Table 3A to obtain an image forming member for electrophotography.

Using the thus obtained image forming member, images were formed on transfer papers according to the same procedure and under the same conditions as in Example 1 to obtain a very clear image quality.

EXAMPLE 4

Layer formation was conducted in entirely the same manner as in Example 1 except that the content of germanium atoms in the first layer was varied by varying the flow rate ratio of $GeH_4$/He gas to $SiH_4$/He gas as shown in Table 4A to prepare image forming members for electrophotography, respectively.

Using the image forming members thus obtained. images were formed on transfer papers according to the same procedure under the same conditions as in Example 1 to obtain the results as shown in Table 4A.

EXAMPLE 5

Layer formation was conducted in entirely the same manner as in Example 1 except that the layer thickness of the first layer was varied as shown in Table 5A to prepare image forming members for electrophotography, respectively.

Using the image forming members thus obtained, images were formed on transfer papers according to the same procedure under the same conditions as in Example 1 to obtain the results as shown in Table 5A.

EXAMPLE 6

By means of the preparation device as shown in FIG. 11, layers were formed on a cylindrical aluminum substrate under the conditions as indicated in Table 6A to obtain an image forming member for electrophotography.

The image forming member thus obtained was set in a charging-exposure experimental device, subjected to corona charging at γ5.0 kV for 0.3 sec, followed immediately by irradiation of a light image. As the light source, a tungsten lamp was employed and irradiation was effected at 2 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper with corona charging at ⊖5.0 KV, there was obtained a clear image with high density which was excellent in resolution and good in halftone reproducibility.

EXAMPLE 7

Using an image forming member for electrophotography prepared under the same conditions as in Example 1, evaluation of the image quality was performed of the transferred toner images formed under the same toner image forming conditions as in Example 1 except that electrostatic images were formed by use of a GaAs system semiconductor laser (10 mW) at 810 nm in place of the tungsten lamp as the light source. As the result, there could be obtained clear images of high quality which were excellent in resolution and good in halftone reproducibility.

EXAMPLE 8

Figure 12:
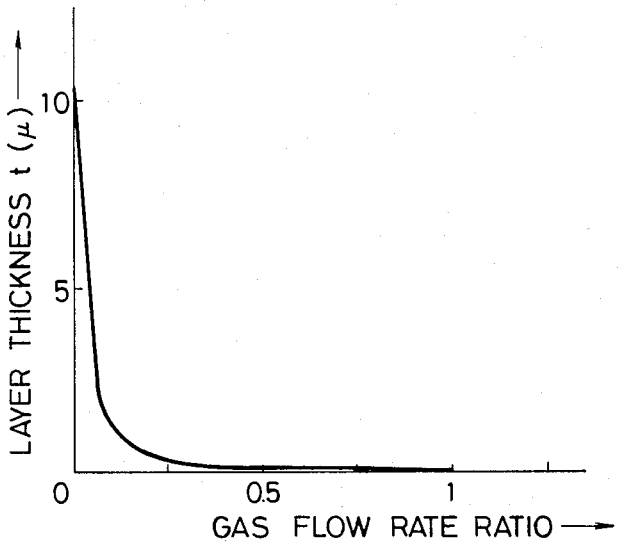
FIGS. 12 through 27 graphs showing the change rate curves of the gas flow rate ratios in Examples of the present invention, respectively.

By means of the preparation device as shown in FIG. 11, layers were formed on a cylindrical aluminum substrate under the conditions as indicated in Table 1B, while varying the gas flow rate ratio of $GeH_4$/He gas to $SiH_4$/He gas with lapse of time for layer formation in accordance with the change rate curve of gas flow rate ratio as shown in FIG. 12 to obtain an image forming member for electrophotography.

The image forming member thus obtained was set in a charging-exposure experimental device, subjected to corona charging at ⊖5.0 kV for 0.3 sec, followed immediately by irradiation of a light image. As the light source, a tungsten lamp was employed and irradiation was effected at 2 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper with corona charging at ⊖5.0 KV, there was obtained a clear image with high density which was excellent in resolution and good in halftone reproducibility.

EXAMPLE 9

Figure 13:
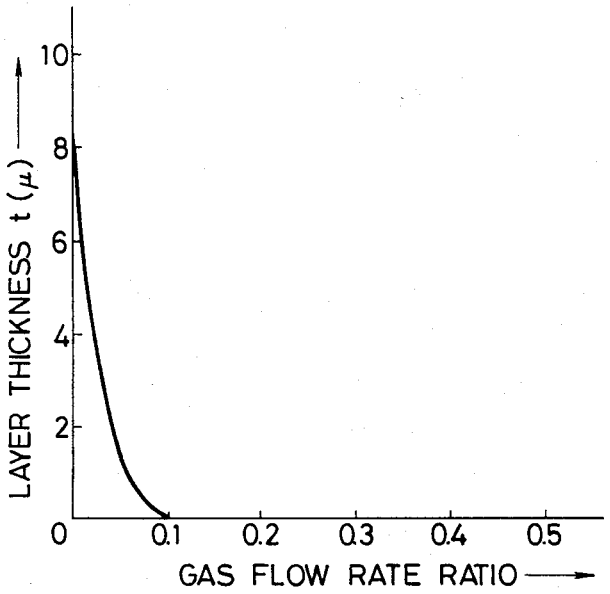

By means of the preparation device as shown in FIG. 11, layer formation was performed under the conditions as indicated in Table 2B, while varying the gas flow rate radio of $GeH_4$/He gas to $SiH_4$/He gas with lapse of time for layer formation in accordance with the change rate curve of gas flow rate ratio as shown in FIG. 13, under otherwise the same conditions as in Example 8, to obtain an image forming member for electrophotography.

Using the image forming member thus obtained, images were formed on transfer papers according to the same procedure and under the same conditions as in Example 8 to obtain very clear image quality.

EXAMPLE 10

Figure 14:
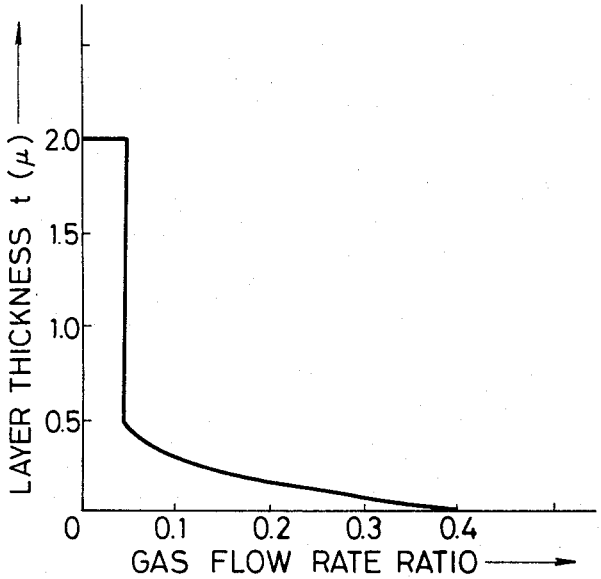

By means of the preparation device as shown in FIG. 11, layer formation was performed under the conditions as indicated in Table 3B, while varying the gas flow rate ratio of $GeH_4$/He gas to $SiH_4$/He gas with lapse of time for layer formation in accordance with the change rate curve of gas flow rate ratio as shown in FIG. 14, under otherwise the same conditions as in Example 8, to obtain an image forming member for electrophotography.

Using the image forming member thus obtained, images were formed on transfer papers according to the same procedure and under the same conditions as in Example 8 to obtain very clear image quality.

EXAMPLE 11

Figure 15:
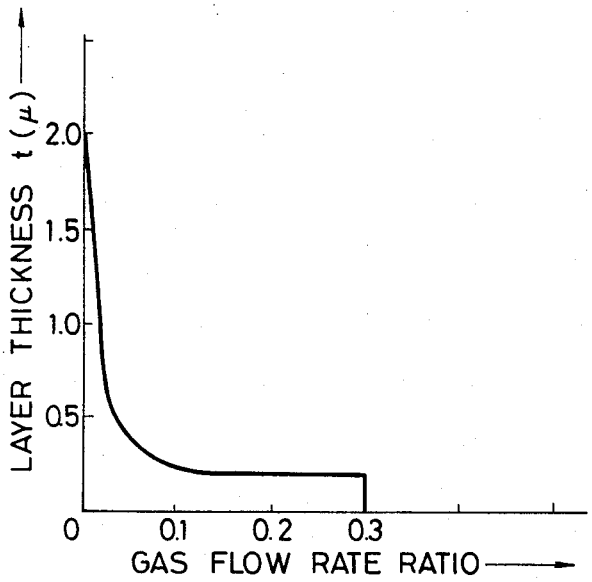

By means of the preparation device as shown in FIG. 11, layer formation was performed under the conditions as indicated in Table 4B, while varying the gas flow rate ratio of $GeH_4$/He gas to $SiH_4$/He gas with lapse of time for layer formation in accordance with the change rate curve of gas flow rate ratio as shown in FIG. 15, under otherwise the same conditions as in Example 8, to obtain an image forming member for electrophotography.

Using the image forming member thus obtained, images were formed on transfer papers according to the same procedure and under the same conditions as in Example 8 to obtain very clear image quality.

EXAMPLE 12

Figure 16:
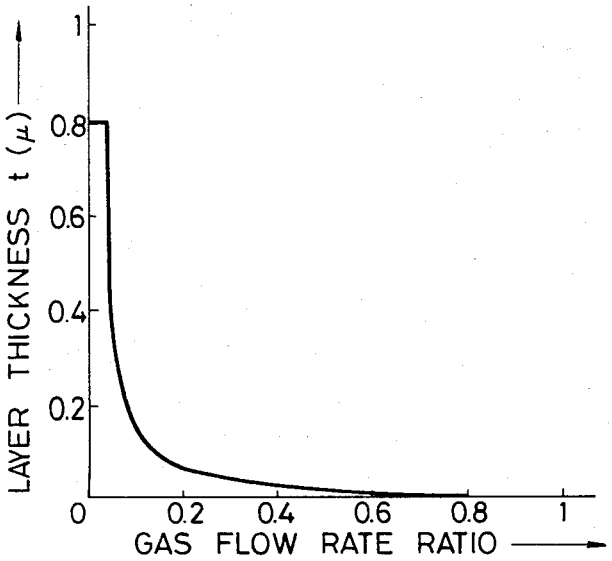

By means of the preparation device as shown in FIG. 11 layer formation was performed under the conditions as indicated in Table 5B, while varying the gas flow rate ratio of $GeH_4$/He gas to $SiH_4$/He gas with lapse of time for layer formation in accordance with the change rate curve of gas flow rate ratio as shown in FIG. 16, under otherwise the same conditions as in Example 8, to obtain an image forming member for electrophotography.

Using the image forming member thus obtained, images were formed on transfer papers according to the same procedure and under the same conditions as in Example 8 to obtain very clear image quality.

EXAMPLE 13

Figure 17:
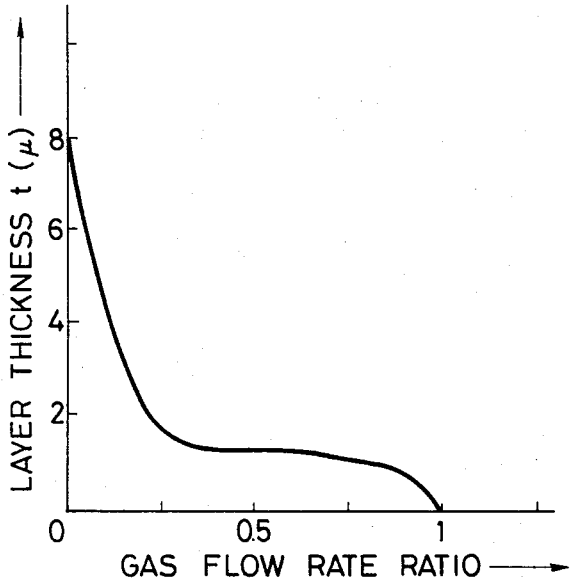

By means of the preparation device as shown in FIG. 11, layer formation was performed under the conditions as indicated in Table 6B, while varying the gas flow rate ratio of $GeH_4$/He gas to $SiH_4$/He gas with lapse of time for layer formation in accordance with the change rate curve of gas flow rate ratio as shown in FIG. 17, under otherwise the same conditions as in Example 8, to obtain an image forming member for electrophotography.

Using the image forming member thus obtained, images were formed on transfer papers according to the same procedure and under the same conditions as in Example 8 to obtain very clear image quality.

EXAMPLE 14

Figure 18:
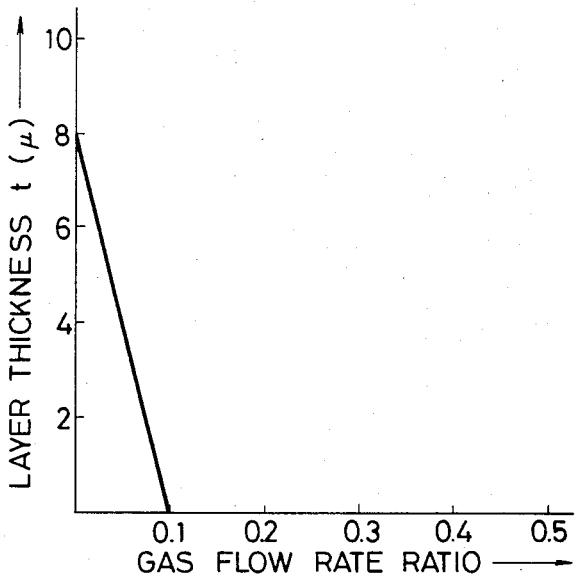

By means of the preparation device as shown in FIG. 11, layer formation was performed under the conditions as indicated in Table 7B, while varying the gas flow rate ratio $GeH_4$/He gas to $SiH_4$/He gas with lapse of time for layer formation in accordance with the change rate curve of gas flow rate ratio as shown in FIG. 18, under otherwise the same conditions as in Example 8, to obtain an image forming member for electrophotography.

Using the image forming member thus obtained, images were formed on transfer papers according to the same procedure and under the same conditions as in Example 8 to obtain very clear image quality.

EXAMPLE 15

Layers were formed under the same conditions as in Example 8 except that $Si_2H_6$/He gas was employed in place of $SiH_4$/He gas and the conditions were changed to those as indicated in Table 8B to obtain an image forming member for electrophotography.

Using the image forming member thus obtained, images were formed on transfer papers according to the same procedure and under the same conditions as in Example 8 to obtain very clear image quality.

EXAMPLE 16

Layers were formed under the same conditions as in Example 8 except that $SiF_4$/He gas was employed in place of $SiH_4$/He gas and the conditions were changed to those as indicated in Table 9B to obtain an image forming member for electrophotography.

Using the image forming member thus obtained, images were formed on transfer papers according to the same procedure and under the same conditions as in Example 8 to obtain very clear image quality.

EXAMPLE 17

Layers were formed under the same conditions as in Example 8 except that ($SiH_4$/He+$SiF_4$/He) gas was employed in place of $SiH_4$/He gas and the conditions were changed to those as indicated in Table 10B to obtain an image forming member for electrophotography.

Using the image forming member thus obtained, images were formed on transfer papers according to the same procedure and under the same conditions as in Example 8 to obtain very clear image quality.

EXAMPLE 18

In Examples 8 to 17, the conditions for preparation of the second layer were changed to those as shown in Table 11B, under otherwise the same conditions as in those Examples, to prepare image forming members for electrophotography, respectively.

Using the thus prepared image forming members, images were formed according to the same procedure and under the same conditions as in Example 8 to obtain the results as shown in Table 12B.

EXAMPLE 19

In Examples 8 to 17, the conditions for preparation of the second layer were changed to those as shown in Table 13B, under otherwise the same conditions as in those Examples, to prepare image forming members for electrophotography, respectively.

Using the thus prepared image forming members, images were formed according to the same procedure and under the same conditions as in Example 8 to obtain the results as shown in Table 14B.

EXAMPLE 20

Using an image forming member for electrophotography prepared under the same conditions as in Example 8, evaluation of the image quality was performed for the transferred toner images formed under the same toner image forming conditions as in Example 8 except that electrostatic images were formed by use of a GaAs system semiconductor laser (10 mW) at 810 nm in place of the tungsten lamp as the light source. As the result, there could be obtained clear images of high quality which were excellent in resolution and good in halftone reproducibility.

EXAMPLE 21

By means of the preparation device as shown in FIG. 11, layers were formed on a cylindrical aluminum substrate under the conditions as indicated in Table 1C to obtain an image forming member for electrophotography.

The image forming member thus obtained was set in a charging-exposure experimental device, subjected to corona charging at ⊕5.0 kV for 0.3 sec, followed immediately by irradiation of a light image. As the light source, a tungsten lamp was employed and irradiation was effected at 2 lux.sec. using a transmissive type test chart.

Immediately thereafter, a negatively charged developer (containing toner and carrier) was cascaded onto the surface of the image forming member, whereby a good toner image was obtained thereon. When the toner image on the member was transferred onto a transfer paper with corona charging at ⊕5.0 KV, there was obtained a clear image with high density which was excellent in resolution and good in halftone reproducibility.

EXAMPLE 22

By means of the preparation device as shown in FIG. 11, layers were formed in the same manner as in Example 21 except that the conditions were changed to those as shown in Table 2C to obtain an image forming member for electrophotography.

Using the thus obtained image forming member, images were formed on transfer papers according to the same procedure and under the same conditions as in Example 21 except that the polarity in corona charging and the charged polarity of the developer were made opposite to those in Example 21, respectively, to obtain a very clear image quality.

EXAMPLE 23

By means of the preparation device as shown in FIG. 11, layers were formed in the same manner as in Example 21 except that the conditions were changed to those as shown in Table 3C to obtain an image forming member for electrophotography.

Using the thus obtained image forming member, images were formed on transfer papers according to the same procedure and under the same conditions as in Example 21 to obtain a very clear image quality.

EXAMPLE 24

Layer formation was conducted in entirely the same manner as in Example 21 except that the content of germanium atoms in the first layer was varied by varying the flow rate ratio of $GeH_4$/He gas to $SiH_4$/He gas as shown in Table 4C to prepare image forming members for electrophotography, respectively.

Using the image forming members thus obtained, images were formed on transfer papers according to the same procedure under the same conditions as in Example 21 to obtain the results as shown in Table 4C.

EXAMPLE 25

Layer formation was conducted in entirely the same manner as in Example 21 except that the layer thickness of the first layer was varied as shown in Table 5C to prepare image forming members for electrophotography, respectively.

Using the image forming members thus obtained, images were formed on transfer papers according to the same procedure under the same conditions as in Example 21 to obtain the results as shown in Table 5C.

EXAMPLE 26

By means of the preparation device as shown in FIG. 11, layers were formed on a cylindrical aluminum substrate under the conditions as indicated in Table 6C to obtain an image forming member for electrophotography.

The image forming member thus obtained was set in a charging-exposure experimental device, subjected to corona charging at ⊕5.0 kV for 0.3 sec, followed immediately by irradiation of a light image. As the light source, a tungsten lamp was employed and irradiation was effected at 2 lux.sec. using a transmissive type test chart.

Immediately thereafter, a negatively charged developer (containing toner and carrier) was cascaded onto the surface of the image forming member, whereby a good toner image was obtained thereon. When the toner image on the member was transferred onto a transfer paper with corona charging at ⊕5.0 KV, there was obtained a clear image with high density which was excellent in resolution and good in halftone reproducibility.

EXAMPLE 27

By means of the preparation device as shown in FIG. 11, layers were formed on a cylindrical aluminum substrate under the conditions as indicated in Table 7C to obtain an image forming member for electrophotography.

The image forming member thus obtained was set in a charging-exposure experimental device, subjected to corona charging at ⊖5.0 kV for 0.3 sec, followed immediately by irradiation of a light image. As the light source, a tungsten lamp was employed and irradiation was effected at 2 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper with corona charging at ⊖5.0 KV, there was obtained a clear image with high density which was excellent in resolution and good in halftone reproducibility.

EXAMPLE 28

By means of the preparation device as shown in FIG. 11, layers were formed on a cylindrical aluminum substrate under the conditions as indicated in Table 8C to obtain an image forming member for electrophotography.

The image forming member thus obtained was set in a charging-exposure experimental device, subjected to corona charging at ⊖5.0 kV for 0.3 sec, followed immediately by irradiation of a light image. As the light source, a tungsten lamp was employed and irradiation was effected at 2 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper subjected to corona charging at ⊖5.0 KV, there was obtained a clear image with high density which was excellent in resolution and good in halftone reproducibility.

EXAMPLE 29

By means of the preparation device as shown in FIG. 11, layers were formed in the same manner as in Example 21 except that the conditions were changed to those as shown in Table 9C to obtain an image forming member for electrophotography.

Using the thus obtained image forming member, images were formed on transfer papers according to the same procedure and under the same conditions as in Example 21 to obtain a very clear image quality.

EXAMPLE 30

By means of the preparation device as shown in FIG. 11, layers were formed in the same manner as in Example 21 except that the conditions were changed to those as shown in Table 10C to obtain an image forming member for electrophotography.

Using the thus obtained image forming member, images were formed on transfer papers according to the same procedure and under the same conditions as in Example 21 to obtain a very clear image quality.

EXAMPLE 31

Using an image forming member for electrophotography prepared under the same conditions as in Example 21, evaluation of the image quality was performed for the transferred toner images formed under the same toner image forming conditions as in Example 21 except that electrostatic images were formed by use of a GaAs system semiconductor laser (10 mW) at 810 nm in place of the tungsten lamp as the light source. As the result, there could be obtained clear images of high quality which were excellent in resolution and good in halftone reproducibility.

EXAMPLE 32

Figure 19:
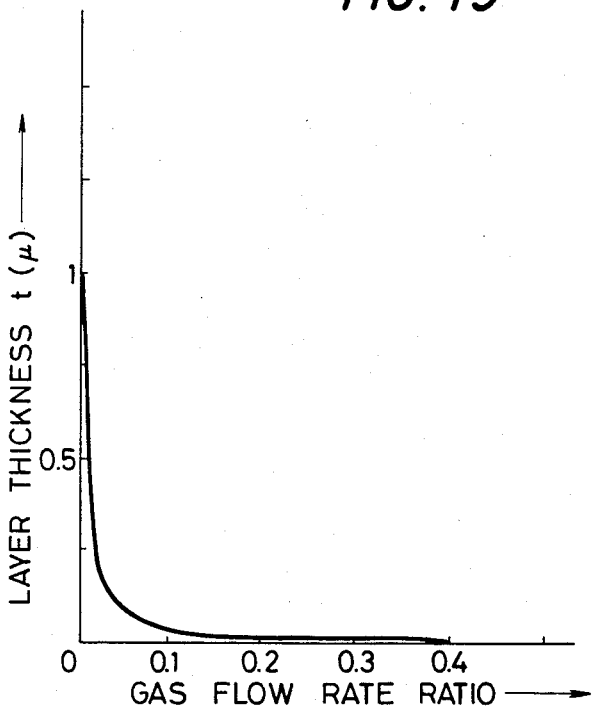

By means of the preparation device as shown in FIG. 11, layers were formed on a cylindrical aluminum substrate under the conditions as indicated in Table 1D, while varying the gas flow rate ratio of $GeH_4$/He gas to $SiH_4$/He gas with lapse of time for layer formation in accordance with the change rate curve of gas flow rate ratio as shown in FIG. 19 to obtain an image forming member for electrophotography.

The image forming member thus obtained was set in a charging-exposure experimental device, subjected to corona charging at ⊖5.0 kV for 0.3 sec, followed immediately by irradiation of a light image. As the light source, a tungsten lamp was employed and irradiation was effected at 2 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper with corona charging at ⊖5.0 KV, there was obtained a clear image with high density which was excellent in resolution and good in halftone reproducibility.

EXAMPLE 33

Figure 20:
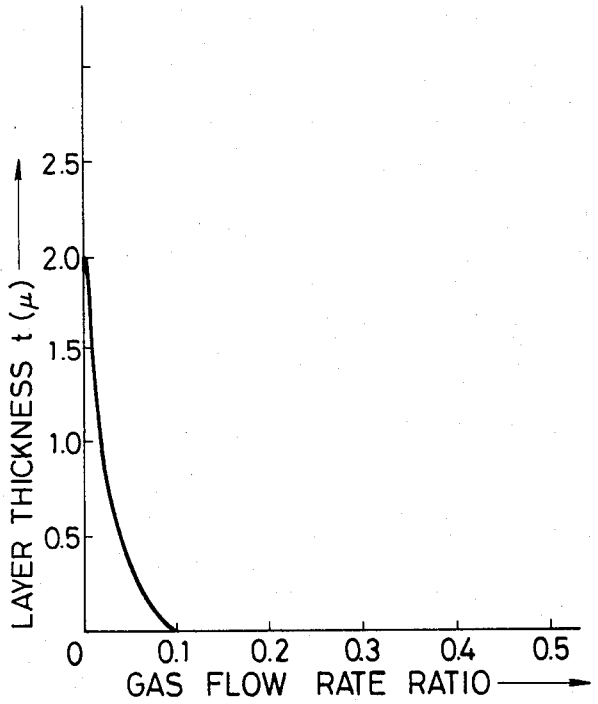

By means of the preparation device as shown in FIG. 11, layer formation was performed under the conditions as indicated in Table 2D, while varying the gas flow rate ratio of $GeH_4$/He gas to $SiH_4$/He gas with lapse of time for layer formation in accordance with the change rate curve of gas flow rate ratio as shown in FIG. 20, under otherwise the same conditions as in Example 32, to obtain an image forming member for electrophotography.

Using the image forming member thus obtained, images were formed on transfer papers according to the same procedure and under the same conditions as in Example 32 to obtain very clear image quality.

EXAMPLE 34

By means of the preparation device as shown in FIG. 11, layer formation was performed under the conditions as indicated in Table 3D, while varying the gas flow rate ratio of $GeH_4$/He gas to $SiH_4$/He gas with lapse of time for layer formation in accordance with the change rate curve of gas flow rate ratio as shown in FIG. 14, under otherwise the same conditions as in Example 32, to obtain an image forming member for electrophotography.

Using the image forming member thus obtained, images were formed on transfer papers according to the same procedure and under the same conditions as in Example 32 to obtain very clear image quality.

EXAMPLE 35

Figure 21:
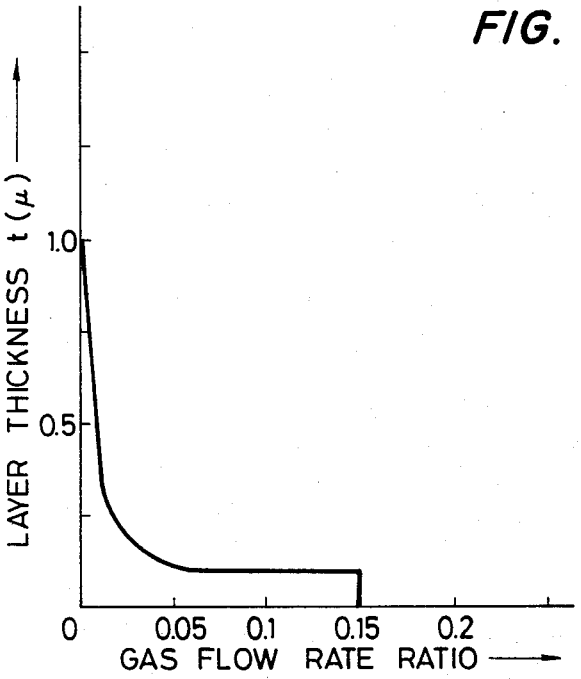

By means of the preparation device as shown in FIG. 11, layer formation was performed under the conditions as indicated in Table 4D, while varying the gas flow rate ratio of $GeH_4$/He gas to $SiH_4$/He gas with lapse of time for layer formation in accordance with the change rate curve of gas flow rate ratio as shown in FIG. 21, under otherwise the same conditions as in Example 32, to obtain an image forming member for electrophotography.

Using the image forming member thus obtained, images were formed on transfer papers according to the same procedure and under the same conditions as in Example 32 to obtain very clear image quality.

EXAMPLE 36

Figure 22:
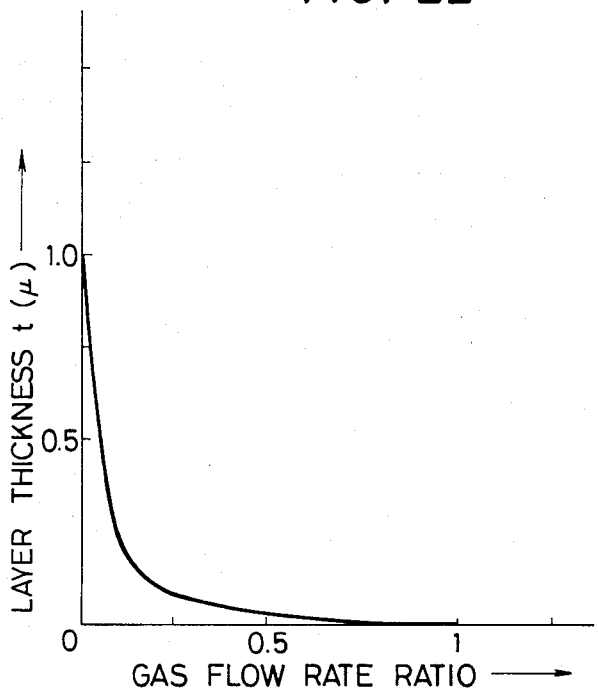

By means of the preparation device as shown in FIG. 11, layer formation was performed under the conditions as indicated in Table 5D, while varying the gas flow rate ratio of $GeH_4$/He gas to $SiH_4$/He gas with lapse of time for layer formation in accordance with the change rate curve of gas flow rate ratio as shown in FIG. 22, under otherwise the same conditions as in Example 32, to obtain an image forming member for electrophotography.

Using the image forming member thus obtained, images were formed on transfer papers according to the same procedure and under the same conditions as in Example 32 to obtain very clear image quality.

EXAMPLE 37

Figure 23:
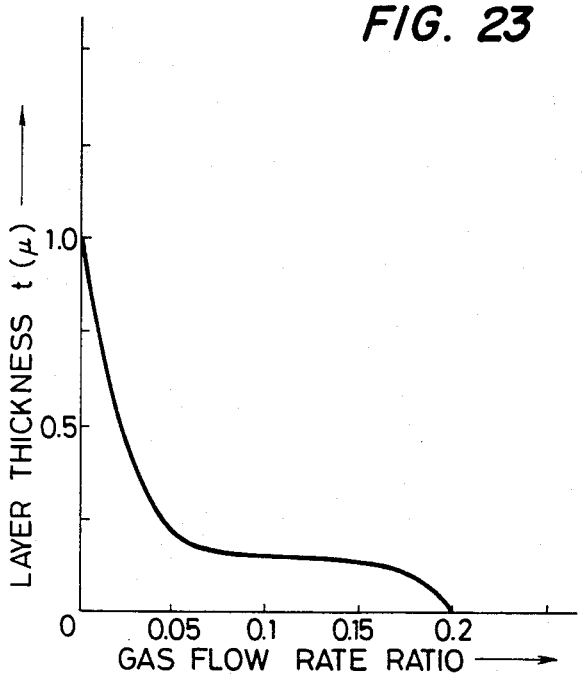

By means of the preparation device as shown in FIG. 11, layer formation was performed under the conditions as indicated in Table 6D, while varying the gas flow rate ratio of $GeH_4$/He gas to $SiH_4$/He gas with lapse of time for layer formation in accordance with the change rate curve of gas flow rate ratio as shown in FIG. 23, under otherwise the same conditions as in Example 32, to obtain an image forming member for electrophotography.

Using the image forming member thus obtained, images were formed on transfer papers according to the same procedure and under the same conditions as in Example 32 to obtain very clear image quality.

EXAMPLE 38

Figure 24:
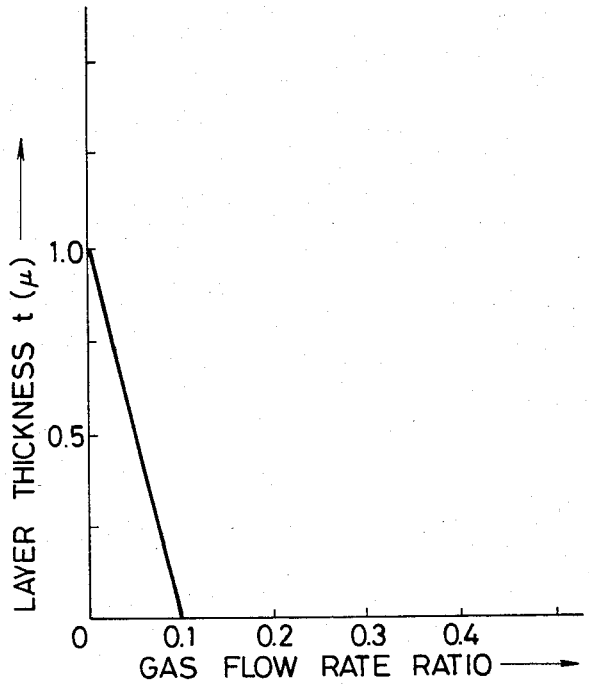

By means of the preparation device as shown in FIG. 11, layer formation was performed under the conditions as indicated in Table 7D, while varying the gas flow rate ratio of $GeH_4$/He gas to $SiH_4$/He gas with lapse of time for layer formation in accordance with the change rate curve of gas flow rate ratio as shown in FIG. 24, under otherwise the same conditions as in Example 32, to obtain an image forming member for electrophotography.

Using the image forming member thus obtained, images were formed on transfer papers according to the same procedure and under the same conditions as in Example 32 to obtain very clear image quality.

EXAMPLE 39

Layers were formed under the same conditions as in Example 32 except that $Si_2H_6$/He gas was employed in place of $SiH_4$/He gas and the conditions were changed to those as indicated in Table 8D to obtain an image forming member for electrophotography.

Using the image forming member thus obtained, images were formed on transfer papers according to the same procedure and under the same conditions as in Example 32 to obtain very clear image quality.

EXAMPLE 40

Layers were formed under the same conditions as in Example 32 except that $SiF_4$/He gas was employed in place of $SiH_4$/He gas and the conditions were changed to those as indicated in Table 9D to obtain an image forming member for electrophotography.

Using the image forming member thus obtained, images were formed on transfer papers according to the same procedure and under the same conditions as in Example 32 to obtain very clear image quality.

EXAMPLE 41

Layers were formed under the same conditions as in Example 32 except that ($SiH_4$/He+$SiF_4$/He) gas was employed in place of $SiH_4$/He gas and the conditions were changed to those as indicated in Table 10D to obtain an image forming member for electrophotography.

Using the image forming member thus obtained, images were formed on transfer papers according to the same procedure and under the same conditions as in Example 32 to obtain very clear image quality.

EXAMPLE 42

By means of the preparation device as shown in FIG. 11, layers were formed on a cylindrical aluminum substrate under the conditions as indicated in Table 11D, while varying the gas flow rate ratio of $GeH_4$/He gas to $SiH_4$/He gas with lapse of time for layer formation in accordance with the change rate curve of gas flow rate ratio as shown in FIG. 19 to obtain an image forming member for electrophotography.

The image forming member thus obtained was set in a charge-exposure experimental device, subjected to corona charging at ⊖5.0 kV for 0.3 sec, followed immediately by irradiation of a light image. As the light source, a tungsten lamp was employed and irradiation was effected at 2 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper subjected to corona charging at ⊖5.0 KV, there was obtained a clear image with high density which was excellent in resolution and good in halftone reproducibility.

EXAMPLE 43

In Example 42, the flow rate of $B_2H_6$ relative to ($SiH_4$+$GeH_4$) was varied during preparation of the first layer, while the flow rate of $B_2H_6$ relative to $SiH_4$ was varied during preparation of the second layer, as indicated in Table 12D, under otherwise the same conditions as in Example 42, to obtain respective image forming members for electrophotography.

Using the image forming members thus obtained, images were formed on transfer papers according to the same procedure and under the same conditions as in Example 42 to obtain the results as shown in Table 12D.

EXAMPLE 44

In Examples 32 to 41, the conditions for preparation of the second layer were changed to those as shown in Table 13D, under otherwise the same conditions as in respective Examples, to prepare image forming members for electrophotography, respectively.

Using the thus prepared image forming members, images were formed according to the same procedure and under the same conditions as in Example 32 to obtain the results as shown in Table 14D.

EXAMPLE 45

In Examples 32 to 41, the conditions for preparation of the second layer were changed to those as shown in Table 15D, under otherwise the same conditions as in respective Examples, to prepare image forming members for electrophotography, respectively.

Using the thus prepared image forming members, images were formed according to the same procedure and under the same conditions as in Example 32 to obtain the results as shown in Table 15D.

EXAMPLE 46

Using an image forming member for electrophotography prepared under the same conditions as in Example 32, evaluation of the image quality was performed for the transferred toner images formed under the same toner image forming conditions as in Example 32 except that electrostatic images were formed by use of a GaAs system semiconductor layer (10 mW) at 810 nm in place of the tungsten lamp as the light source. As the result, there could be obtained clear images of high quality which were excellent in resolution and good in halftone reproducibility.

EXAMPLE 47

By means of the preparation device as shown in FIG. 11, layers were formed on a cylindrical aluminum substrate under the conditions as indicated in Table 1E to obtain an image forming member for electrophotography.

The image forming member thus obtained was set in a charging-exposure experimental device, subjected to corona charging at ⊖5.0 kV for 0.3 sec, followed immediately by irradiation of a light image. As the light source, a tungsten lamp was employed and irradiation was effected at 2 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper subjected to corona charging at ⊖5.0 KV, there was obtained a clear image with high density which was excellent in resolution and good in halftone reproducibility.

EXAMPLE 48

By means of the preparation device as shown in FIG. 11, layers were formed in the same manner as in Example 47 except that the conditions were changed to those as shown in Table 2E to obtain an image forming member for electrophotography.

Using the thus obtained image forming member, images were formed on transfer papers according to the same procedure and under the same conditions as in Example 47 except that the polarity in corona charging and the charged polarity of the developer were made opposite to those in Example 47, respectively, to obtain a very clear image quality.

EXAMPLE 49

By means of the preparation device as shown in FIG. 11, layers were formed in the same manner as in Example 47 except that the conditions were changed to those as shown in Table 3E to obtain an image forming member for electrophotography.

Using the thus obtained image forming member, images were formed on transfer papers according to the same procedure and under the same conditions as in Example 47 to obtain a very clear image quality.

EXAMPLE 50

Layer formation was conducted in entirely the same manner as in Example 47 except that the content of germanium atoms in the first layer was varied by varying the flow rate ratio of $GeH_4$/He gas to $SiH_4$/He gas as shown in Table 4E to prepare image forming members for electrophotography, respectively.

Using the image forming members thus obtained, images were formed on transfer papers according to the same procedure under the same conditions as in Example 47 to obtain the results as shown in Table 4E.

EXAMPLE 51

Layer formation was conducted in entirely the same manner as in Example 47 except that the layer thickness of the first layer was varied as shown in Table 5E to prepare image forming members for electrophotography, respectively.

Using the image forming members thus obtained, images were formed on transfer papers according to the same procedure under the same conditions as in Example 47 to obtain the results as shown in Table 5E.

EXAMPLE 52

By means of the preparation device as shown in FIG. 11, layers were formed on a cylindrical aluminum substrate under the conditions as indicated in Table 6E to obtain an image forming member for electrophotography.

The image forming member thus obtained was set in a charging-exposure experimental device, subjected to corona charging at ⊖5.0 kV for 0.3 sec, followed immediately by irradiation of a light image. As the light source, a tungsten lamp was employed and irradiation was effected at 2 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper subjected to corona charging at ⊖5.0 KV, there was obtained a clear image with high density which was excellent in resolution and good in halftone reproducibility.

EXAMPLE 53

Using an image forming member for electrophotography prepared under the same conditions as in Example 47, evaluation of the image quality was performed for the transferred toner images formed under the same toner image forming conditions as in Example 47 except that electrostatic images were formed by use of a GaAs system semiconductor laser (10 mW) at 810 nm in place of the tungsten lamp as the light source. As the result, there could be obtained clear images of high quality which were excellent in resolution and good in halftone reproducibility.

EXAMPLE 54

By means of the preparation device as shown in FIG. 11, layers were formed on a cylindrical aluminum substrate under the conditions as indicated in Table 1F, while varying the gas flow rate ratio of $GeH_4$/He gas to $SiH_4$/He gas with lapse of time for layer formation in accordance with the change rate curve of gas flow rate ratio as shown in FIG. 12 to obtain an image forming member for electrophotography.

The image forming member thus obtained was set in a charging-exposure experimental device, subjected to corona charging at ⊖5.0 kV for 0.3 sec, followed immediately by irradiation of a light image. As the light source, a tungsten lamp was employed and irradiation was effected at 2 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper subjected to corona charging at ⊖5.0 KV, there was obtained a clear image with high density which was excellent in resolution and good in halftone reproducibility.

EXAMPLE 55

By means of the preparation device as shown in FIG. 11, layer formation was performed under the conditions as indicated in Table 2F, while varying the gas flow rate ratio of $GeH_4$/He gas to $SiH_4$/He gas with lapse of time for layer formation in accordance with the change rate curve of gas flow rate ratio as shown in FIG. 13, under otherwise the same conditions as in Example 54, to obtain an image forming member for electrophotography.

Using the image forming member thus obtained, images were formed on transfer papers according to the same procedure and under the same conditions as in Example 54 to obtain very clear image quality.

EXAMPLE 56

By means of the preparation device as shown in FIG. 11, layer formation was performed under the conditions as indicated in Table 3F, while varying the gas flow rate ratio of $GeH_4$/He gas to $SiH_4$/He gas with lapse of time for layer formation in accordance with the change rate curve of gas flow rate ratio as shown in FIG. 14, under otherwise the same conditions as in Example 54, to obtain an image forming member for electrophotography.

Using the image forming member thus obtained, images were formed on transfer papers according to the same procedure and under the same conditions as in Example 54 to obtain very clear image quality.

EXAMPLE 57

By means of the preparation device as shown in FIG. 11, layer formation was performed under the conditions as indicated in Table 4F, while varying the gas flow rate ratio of $GeH_4$/He gas to $SiH_4$/He gas with lapse of time for layer formation in accordance with the change rate curve of gas flow rate ratio as shown in FIG. 21, under otherwise the same conditions as in Example 54, to obtain an image forming member for electrophotography.

Using the image forming member thus obtained, images were formed on transfer papers according to the same procedure and under the same conditions as in Example 54 to obtain very clear image quality.

EXAMPLE 58

By means of the preparation device as shown in FIG. 11, layer formation was performed under the conditions as indicated in Table 5F, while varying the gas flow rate ratio of $GeH_4$/He gas to $SiH_4$/He gas with lapse of time for layer formation in accordance with the change rate curve of gas flow rate ratio as shown in FIG. 22, under otherwise the same conditions as in Example 54, to obtain an image forming member for electrophotography.

Using the image forming member thus obtained, images were formed on transfer papers according to the same procedure and under the same conditions as in Example 54 to obtain very clear image quality.

EXAMPLE 59

Figure 25:
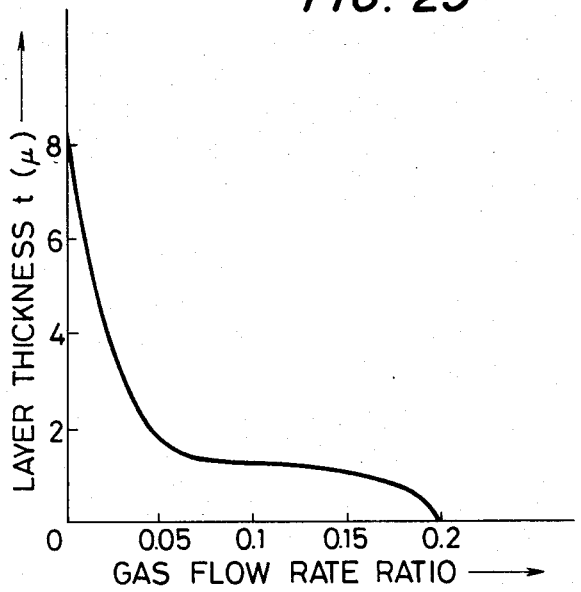

By means of the preparation device as shown in FIG. 11, layer formation was performed under the conditions as indicated in Table 6F, while varying the gas flow rate ratio of $GeH_4$/He gas to $SiH_4$/He gas with lapse of time for layer formation in accordance with the change rate curve of gas flow rate ratio as shown in FIG. 25, under otherwise the same conditions as in Example 54, to obtain an image forming member for electrophotography.

Using the image forming member thus obtained, images were formed on transfer papers according to the same procedure and under the same conditions as in Example 54 to obtain very clear image quality.

EXAMPLE 60

By means of the preparation device as shown in FIG. 11, layer formation was performed under the conditions as indicated in Table 7F, while varying the gas flow rate ratio of $GeH_4$/He gas to $SiH_4$/He gas with lapse of time for layer formation in accordance with the change rate curve of gas flow rate ratio as shown in FIG. 18, under otherwise the same conditions as in Example 54, to obtain an image forming member for electrophotography.

Using the image forming member thus obtained, images were formed on transfer papers according to the same procedure and under the same conditions as in Example 54 to obtain very clear image quality.

EXAMPLE 61

Layers were formed under the same conditions as in Example 54 except that $Si_2H_6$/He gas was employed in place of $SiH_4$/He gas and the conditions were changed to those as indicated in Table 8F to obtain an image forming member for electrophotography.

Using the image forming member thus obtained, images were formed on transfer papers according to the same procedure and under the same conditions as in Example 54 to obtain very clear image quality.

EXAMPLE 62

Layers were formed under the same conditions as in Example 54 except that $SiF_4$/He gas was employed in place of $SiH_4$/He gas and the conditions were changed to those as indicated in Table 9F to obtain an image forming member for electrophotography.

Using the image forming member thus obtained, images were formed on transfer papers according to the same procedure and under the same conditions as in Example 54 to obtain very clear image quality.

EXAMPLE 63

Layers were formed under the same conditions as in Example 54 except that ($SiH_4$/He+$SiF_4$/He) gas was employed in place of $SiH_4$/He gas and the conditions were changed to those as indicated in Table 10F to obtain an image forming member for electrophotography.

Using the image forming member thus obtained, images were formed on transfer papers according to the same procedure and under the same conditions as in Example 54 to obtain very clear image quality.

EXAMPLE 64

In Examples 54 to 63, the conditions for preparation of the second layer were changed to those as shown in Table 11F, under otherwise the same conditions as in respective Examples, to prepare image forming members for electrophotography, respectively.

Using the thus prepared image forming members, images were formed according to the same procedure and under the same conditions as in Example 54 to obtain the results as shown in Table 12F.

EXAMPLE 65

In Examples 54 to 63, the conditions for preparation of the second layer were changed to those as shown in Table 13F, under otherwise the same conditions as in respective Examples, to prepare image forming members for electrophotography, respectively.

Using the thus prepared image forming members, images were formed according to the same procedure and under the same conditions as in Example 54 to obtain the results as shown in Table 14F.

EXAMPLE 66

Figure 26:
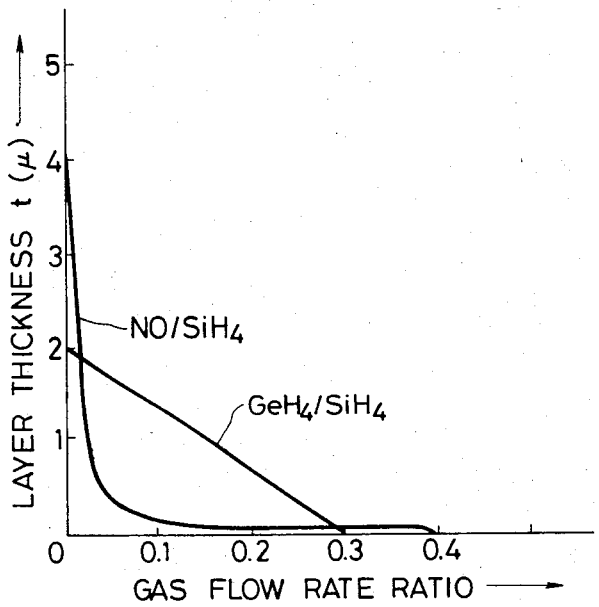

By means of the preparation device as shown in FIG. 11, layer formation was performed under the conditions as indicated in Table 15F while varying the gas flow rate ratio of $GeH_4$/He gas to $SiH_4$/He gas and the gas flow rate ratio of NO gas to $SiH_4$/He gas with lapse of time for layer formation in accordance with the change rate curve of gas flow rate ratio as shown in FIG. 26, under otherwise the same conditions as in Example 54, to obtain an image forming member for electrophotography.

Using the image forming member thus obtained, images were formed on transfer papers according to the same procedure and under the same conditions as in Example 54 to obtain very clear image quality.

EXAMPLE 67

Figure 27:
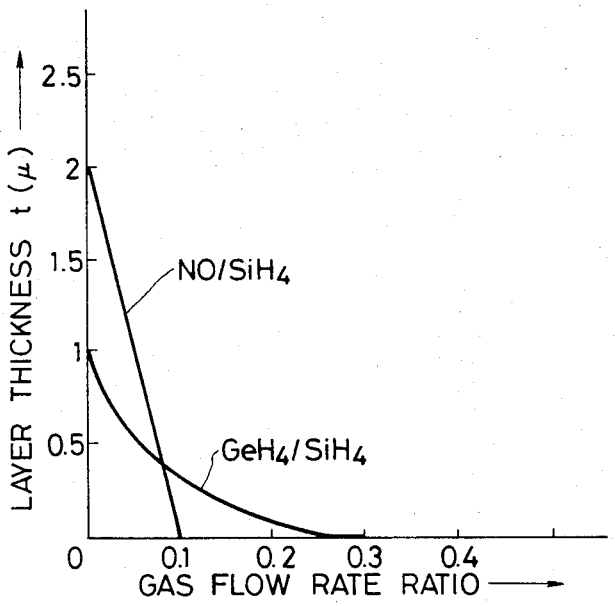

By means of the preparation device as shown in FIG. 11, layer formation was performed under the conditions as indicated in Table 16F, while varying the gas flow rate ratio of $GeH_4$/He gas to $SiH_4$/He gas and the gas flow rate ratio of NO gas to $SiH_4$/He gas with lapse of time for layer formation in accordance with the change rate curve of gas flow rate ratio as shown in FIG. 27, under otherwise the same conditions as in Example 54, to obtain an image forming member for electrophotography.

Using the image forming member thus obtained, images were formed on transfer papers according to the same procedure and under the same conditions as in Example 54 to obtain very clear image quality.

EXAMPLE 68

Using an image forming member for electrophotography prepared under the same conditions as in Examples 54 to 63, evaluation of the image quality was performed for the transferred toner images formed under the same toner image forming conditions as in Example 54 except that electrostatic images were formed by use of a GaAs system semiconductor laser (10 mW) at 810 nm in place of the tungsten lamp as the light source. As the result, there could be obtained clear images of high quality which were excellent in resolution and good in halftone reproducibility.

EXAMPLE 69

By means of the preparation device as shown in FIG. 11, layers were formed on a cylindrical aluminum substrate under the conditions as indicated in Table 1G to obtain an image forming member for electrophotography.

The image forming member thus obtained was set in a charging-exposure experimental device, subjected to corona charging at ⊕5.0 kV for 0.3 sec, followed immediately by irradiation of a light image. As the light source, a tungsten lamp was employed and irradiation was effected at 2 lux.sec. using a transmissive type test chart.

Immediately thereafter, a negatively charged developer (containing toner and carrier) was cascaded onto the surface of the image forming member, whereby a good toner image was obtained thereon. When the toner image on the member was transferred onto a transfer paper subjected to corona charging at ⊕5.0 KV, there was obtained a clear image with high density which was excellent in resolution and good in halftone reproducibility.

EXAMPLE 70

By means of the preparation device as shown in FIG. 11, layers were formed in the same manner as in Example 69 except that the conditions were changed to those as shown in Table 2G to obtain an image forming member for electrophotography.

Using the thus obtained image forming member, images were formed on transfer papers according to the same procedure and under the same conditions as in Example 69 except that the polarity in corona charging and the charged polarity of the developer were made opposite to those in Example 69, respectively, to obtain a very clear image quality.

EXAMPLE 71

By means of the preparation device as shown in FIG. 11, layers were formed in the same manner as in Example 69 except that the conditions were changed to those as shown in Table 3G to obtain an image forming member for electrophotography.

Using the thus obtained image forming member, images were formed on transfer papers according to the same procedure and under the same conditions as in Example 69 to obtain a very clear image quality.

EXAMPLE 72

Layer formation was conducted in entirely the same manner as in Example 69 except that the content of germanium atoms in the first layer was varied by varying the flow rate ratio of $GeH_4$/He gas to $SiH_4$/He gas as shown in Table 4G to prepare image forming members for electrophotography, respectively.

Using the image forming members thus obtained, images were formed on transfer papers according to the same procedure under the same conditions as in Example 69 to obtain the results as shown in Table 4G.

EXAMPLE 73

Layer formation was conducted in entirely the same manner as in Example 69 except that the layer thickness of the first layer was varied as shown in Table 5G to prepare image forming members for electrophotography, respectively.

Using the image forming members thus obtained, images were formed on transfer papers according to the same procedure under the same conditions as in Example 69 to obtain the results as shown in Table 5G.

EXAMPLE 74

By means of the preparation device as shown in FIG. 11, layers were formed on a cylindrical aluminum substrate under the conditions as indicated in Tables 6G to 8G to obtain image forming members (Sample Nos. G601, G602, G603) for electrophotography respectively.

The respective image forming members thus obtained were set in a charging-exposure experimental device, subjected to corona charging at ⊖5.0 kV for 0.3 sec, followed immediately by irradiation of a light image. As the light source, a tungsten lamp was employed and irradiation was effected at 2 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper with corona charging at ⊖5.0 KV, there was obtained a clear image with high density which was excellent in resolution and good in halftone reproducibility.

EXAMPLE 75

By means of the preparation device as shown in FIG. 11, layers were formed in the same manner as in Example 69 except that the conditions were changed to those as shown in Tables 9G and 10G to obtain image forming members (Sample Nos. G701, G702) for electrophotography respectively.

Using the thus obtained image forming members, images were formed on transfer papers according to the same procedure and under the same conditions as in Example 69 to obtain a very clear image quality.

EXAMPLE 76

By means of the preparation device as shown in FIG. 11, layers were formed in the same manner as in Example 69 except that the conditions were changed to those as shown in Tables 11G to 15G to obtain image forming members (Sample Nos. G801 to G805) for electrophotography respectively.

Using the thus obtained image forming members, images were formed on transfer papers according to the same procedure and under the same conditions as in Example 69 to obtain a very clear image quality.

EXAMPLE 77

Using an image forming member for electrophotography prepared under the same conditions as in Example 69, evaluation of the image quality was performed for the transferred toner images formed under the same toner image forming conditions as in Example 69 except that electrostatic images were formed by use of a GaAs system semiconductor laser (10 mW) at 810 nm in place of the tungsten lamp as the light source. As the result, there could be obtained clear images of high quality which were excellent in resolution and good in halftone reproducibility.

EXAMPLE 78

By means of the preparation device as shown in FIG. 11, layers were formed on a cylindrical aluminum substrate under the conditions as indicated in Table 1H, while varying the gas flow rate ratio of $GeH_4$/He gas to $SiH_4$/He gas with lapse of time for layer formation in accordance with the change rate curve of gas flow rate ratio as shown in FIG. 19 to obtain an image forming member for electrophotography.

The image forming member thus obtained was set in a charging-exposure experimental device, subjected to corona charging at ⊖5.0 kV for 0.3 sec, followed immediately by irradiation of a light image. As the light source, a tungsten lamp was employed and irradiation was effected at 2 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper subjected to corona charging at ⊖5.0 KV, there was obtained a clear image with high density which was excellent in resolution and good in halftone reproducibility.

EXAMPLE 79

By means of the preparation device as shown in FIG. 11, layer formation was performed under the conditions as indicated in Table 2H, while varying the gas flow rate ratio of $GeH_4$/He gas to $SiH_4$/He gas with lapse of time for layer formation in accordance with the change rate curve of gas flow rate ratio as shown in FIG. 20, under otherwise the same conditions as in Example 78, to obtain an image forming member for electrophotography.

Using the image forming member thus obtained, images were formed on transfer papers according to the same procedure and under the same conditions as in Example 78 to obtain very clear image quality.

EXAMPLE 80

By means of the preparation device as shown in FIG. 11, layer formation was performed under the conditions as indicated in Table 3H, while varying the gas flow rate ratio of $GeH_4$/He gas to $SiH_4$/He gas with lapse of time for layer formation in accordance with the change rate curve of gas flow rate ratio as shown in FIG. 14, under otherwise the same conditions as in Example 78, to obtain an image forming member for electrophotography.

Using the image forming member thus obtained, images were formed on transfer papers according to the same procedure and under the same conditions as in Example 78 to obtain very clear image quality.

EXAMPLE 81

By means of the preparation device as shown in FIG. 11, layer formation was performed under the conditions as indicated in Table 4H, while varying the gas flow rate ratio of $GeH_4$/He gas to $SiH_4$/He gas with lapse of time for layer formation in accordance with the change rate curve of gas flow rate ratio as shown in FIG. 21, under otherwise the same conditions as in Example 78, to obtain an image forming member for electrophotography.

Using the image forming member thus obtained, images were formed on transfer papers according to the same procedure and under the same conditions as in Example 78 to obtain very clear image quality.

EXAMPLE 82

By means of the preparation device as shown in FIG. 11, layer formation was performed under the conditions as indicated in Table 5H, while varying the gas flow rate ratio of $GeH_4$/He gas to $SiH_4$/He gas with lapse of time for layer formation in accordance with the change rate curve of gas flow rate ratio as shown in FIG. 22, under otherwise the same conditions as in Example 78, to obtain an image forming member for electrophotography.

Using the image forming member thus obtained, images were formed on transfer papers according to the same procedure and under the same conditions as in Example 78 to obtain very clear image quality.

EXAMPLE 83

By means of the preparation device as shown in FIG. 11, layer formation was performed under the conditions as indicated in Table 6H, while varying the gas flow rate ratio of $GeH_4$/He gas to $SiH_4$/He gas with lapse of time for layer formation in accordance with the change rate curve of gas flow rate ratio as shown in FIG. 23, under otherwise the same conditions as in Example 78, to obtain an image forming member for electrophotography.

Using the image forming member thus obtained, images were formed on transfer papers according to the same procedure and under the same conditions as in Example 78 to obtain very clear image quality.

EXAMPLE 84

By means of the preparation device as shown in FIG. 11, layer formation was performed under the conditions as indicated in Table 7H, while varying the gas flow rate ratio of $GeH_4$/He gas to $SiH_4$/He gas with lapse of time for layer formation in accordance with the change rate curve of gas flow rate ratio as shown in FIG. 24, under otherwise the same conditions as in Example 78, to obtain an image forming member for electrophotography.

Using the image forming member thus obtained, images were formed on transfer papers according to the same procedure and under the same conditions as in Example 78 to obtain very clear image quality.

EXAMPLE 85

Layers were formed under the same conditions as in Example 78 except that $Si_2H_6$/He gas was employed in place of $SiH_4$/He gas and the conditions were changed to those as indicated in Table 8H to obtain an image forming member for electrophotography.

Using the image forming member thus obtained, images were formed on transfer papers according to the same procedure and under the same conditions as in Example 78 to obtain very clear image quality.

EXAMPLE 86

Layers were formed under the same conditions as in Example 78 except that $SiF_4$/He gas was employed in place of $SiH_4$/He gas and the conditions were changed to those as indicated in Table 9H to obtain an image forming member for electrophotography.

Using the image forming member thus obtained, images were formed on transfer papers according to the same procedure and under the same conditions as in Example 78 to obtain very clear image quality.

EXAMPLE 87

Layers were formed under the same conditions as in Example 78 except that ($SiH_4$/He+$SiF_4$/He) gas was employed in place of $SiH_4$/He gas and the conditions were changed to those as indicated in Table 10H to obtain an image forming member for electrophotography.

Using the image forming member thus obtained, images were formed on transfer papers according to the same procedure and under the same conditions as in Example 78 to obtain very clear image quality.

EXAMPLE 88

By means of the preparation device as shown in FIG. 11, layers were formed on a cylindrical aluminum substrate under the conditions as indicated in Table 11H, while varying the gas flow rate ratio of $GeH_4$/He gas to $SiH_4$/He gas with lapse of time for layer formation in accordance with the change rate curve of gas flow rate ratio as shown in FIG. 19 to obtain an image forming member for electrophotography.

The image forming member thus obtained was set in a charging-exposure experimental device, subjected to corona charging at ⊖5.0 kV for 0.3 sec, followed immediately by irradiation of a light image. As the light source, a tungsten lamp was employed and irradiation was effected at 2 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper with corona charging at ⊖5.0 KV, there was obtained a clear image with high density which was excellent in resolution and good in halftone reproducibility.

EXAMPLE 89

In Example 88, the flow rate of $B_2H_6$ relative to ($SiH_4$+$GeH_4$) was varied during preparation of the first layer, while the flow rate of $B_2H_6$ relative to $SiH_4$ was varied during preparation of the second layer, as indicated in Table 12G, under otherwise the same conditions as in Example 88, to obtain respective image forming members for electrophotography.

Using the image forming members thus obtained, images were formed on transfer papers according to the same procedure and under the same conditions as in Example 88 to obtain the results as shown in Table 12G.

EXAMPLE 90

In Examples 78 to 87, the conditions for preparation of the second layer were changed to those as shown in Tables 13G and 14G, under otherwise the same conditions as in respective Examples, to prepare image forming members (Sample Nos. G1301 to G1310, G1401 to G1410) for electrophotography, respectively.

Using the thus prepared image forming members, images were formed according to the same procedure and under the same conditions as in Example 78 to obtain the results as shown in Table 15G.

EXAMPLE 91

Using an image forming member for electrophotography prepared under the same conditions as in Example 78, evaluation of the image quality was performed for the transferred toner images formed under the same toner image forming conditions as in Example 78 except that electrostatic images were formed by use of a GaAs system semiconductor laser (10 mW) at 810 nm in place of the tungsten lamp as the light source. As the result, there could be obtained clear images of high quality which are excellent in resolution and good in halftone reproducibility.

The common layer forming conditions employed in the above Examples of the present invention are shown below:

Substrate temperature: for germanium atom (Ge) containing layer . . . about 200° C., for no germanium atom (Ge) containing layer . . . about 250° C.

Discharging frequency: 13.56 MHz

Inner pressure in reaction chamber during reaction: 0.3 Torr

TABLE 1A

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer | $SiH_4$/He = 0.05<br>$GeH_4$/He = 0.05 | $SiH_4$ + $GeH_4$ = 50 | $GeH_4$/$SiH_4$ = 1 | 0.18 | 5 | 3 |
| Second layer | $SiH_4$/He = 0.5 | $SiH_4$ = 200 | | 0.18 | 15 | 15 |

TABLE 2A

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05 $GeH_4/He$ = 0.05 | $SiH_4 + GeH_4$ = 50 | $GeH_4/SiH_4$ = 0.1 | 0.18 | 5 | 20 |
| Second layer | $SiH_4/He$ = 0.5 | $SiH_4$ = 200 | | 0.18 | 15 | 5 |

TABLE 3A

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05 $GeH_4/He$ = 0.05 | $SiH_4 + GeH_4$ = 50 | $GeH_4/SiH_4$ = 0.4 | 0.18 | 5 | 2 |
| Second layer | $SiH_4/He$ = 0.5 $B_2H_6/He$ = $10^{-3}$ | $SiH_4$ = 200 | $B_2H_6/SiH_4$ = $2 \times 10^{-5}$ | 0.18 | 15 | 20 |

TABLE 4A

| Sample No. | A401 | A402 | A403 | A404 | A405 | A406 | A407 |
|---|---|---|---|---|---|---|---|
| Ge content (atomic %) | 1 | 3 | 5 | 10 | 40 | 60 | 90 |
| Evaluation | Δ | | | | | | Δ |

: Excellent
: Good
Δ : Practically satisfactory

TABLE 5A

| Sample No. | A501 | A502 | A503 | A504 | A505 |
|---|---|---|---|---|---|
| Layer thickness (μ) | 0.1 | 0.5 | 1 | 2 | 5 |
| Evaluation | | | | | |

: Excellent
: Good

TABLE 6A

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05 $GeH_4/He$ = 0.05 | $SiH_4 + GeH_4$ = 50 | $GeH_4/SiH_4$ = 1 | 0.18 | 5 | 2 |
| Second layer | $SiH_4/He$ = 0.5 $PH_3/He$ = $10^{-3}$ | $SiH_4$ = 200 | $PH_3/SiH_4$ = $1 \times 10^{-7}$ | 0.18 | 15 | 20 |

TABLE 1B

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05 $GeH_4/He$ = 0.05 | $SiH_4 + GeH_4$ = 50 | $GeH_4/SiH_4$ = 1~0 | 0.18 | 5 | 10 |
| Second layer | $SiH_4/He$ = 0.5 | $SiH_4$ = 200 | | 0.18 | 15 | 10 |

TABLE 2B

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05 $GeH_4/He$ = 0.05 | $SiH_4 + GeH_4$ = 50 | $GeH_4/SiH_4$ = 1/10~0 | 0.18 | 5 | 8 |
| Second | $SiH_4/He$ = | $SiH_4$ = 200 | | 0.18 | 15 | 10 |

TABLE 2B-continued

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| layer | 0.5 | | | | | |

TABLE 3B

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer | $SiH_4$/He = 0.05 $GeH_4$/He = 0.05 | $SiH_4$ + $GeH_4$ = 50 | $GeH_4$/$SiH_4$ = 4/10~2/1000 | 0.18 | 5 | 2.0 |
| Second layer | $SiH_4$/He = 0.5 | $SiH_4$ = 200 | | 0.18 | 15 | 20 |

TABLE 4B

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer | $SiH_4$/He = 0.05 $GeH_4$/He = 0.05 | $SiH_4$ + $GeH_4$ = 50 | $GeH_4$ + $SiH_4$ = 3/10~0 | 0.18 | 5 | 2.0 |
| Second layer | $SiH_4$/He = 0.5 | $SiH_4$ = 200 | | 0.18 | 15 | 15 |

TABLE 5B

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer | $SiH_4$/He = 0.05 $GeH_4$/He = 0.05 | $SiH_4$ + $GeH_4$ = 50 | $GeH_4$ + $SiH_4$ = 8/10~0 | 0.18 | 5 | 2.0 |
| Second layer | $SiH_4$/He = 0.5 | $SiH_4$ = 200 | | 0.18 | 15 | 20 |

TABLE 6B

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer | $SiH_4$/He = 0.05 $GeH_4$/He = 0.05 | $SiH_4$ + $GeH_4$ = 50 | $GeH_4$/$SiH_4$ = 1~0 | 0.18 | 5 | 8 |
| Second layer | $SiH_4$/He = 0.5 | $SiH_4$ = 200 | | 0.18 | 15 | 15 |

TABLE 7B

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer | $SiH_4$/He = 0.05 $GeH_4$/He = 0.05 | $SiH_4$ + $GeH_4$ = 50 | $GeH_4$/$SiH_4$ = 1/10~0 | 0.18 | 5 | 8 |
| Second layer | $SiH_4$/He = 0.5 | $SiH_4$ = 200 | | 0.18 | 15 | 10 |

TABLE 8B

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $Si_2H_6$/He = 0.05 $GeH_4$/He = 0.05 | $Si_2H_6$ + $GeH_4$ = 50 | $GeH_4/Si_2H_6$ = 1~0 | 0.18 | 5 | 10 |
| Second layer | $SiH_4$/He = 0.5 | $SiH_4$ = 200 | | 0.18 | 15 | 10 |

TABLE 9B

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiF_4$/He = 0.05 $GeH_4$/He = 0.05 | $SiF_4$ + $GeH_4$ = 50 | $GeH_4/SiF_4$ = 1~0 | 0.18 | 5 | 10 |
| Second layer | $SiH_4$/He = 0.5 | $SiH_4$ = 200 | | 0.18 | 15 | 10 |

TABLE 10B

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4$/He = 0.05 $SiF_4$/He = 0.05 $GeH_4$/He = 0.05 | $SiH_4$ + $SiF_4$ + $GeH_4$ = 50 | $GeH_4/(SiH_4 + SiF_4)$ = 1~0 | 0.18 | 5 | 10 |
| Second layer | $SiH_4$/He = 0.5 | $SiH_4$ = 200 | | 0.18 | 15 | 10 |

TABLE 11B

| Layer constitution | Gases employed | Flow rate (SCCM) | Flow rate ratio | Discharging power ($W/cm^2$) | Layer formation speed (Å/sec) |
|---|---|---|---|---|---|
| Second layer | $SiH_4$/He = 0.5 $B_2H_6$/He = $10^{-3}$ | $SiH_4$ = 200 | $B_2H_6SiH_4$ = $2 \times 10^{-5}$ | 0.18 | 15 |

TABLE 12B

| | Sample No. | | | | | | | | | |
|---|---|---|---|---|---|---|---|---|---|---|
| First layer | B1101 Example 8 | B1102 Example 9 | B1103 Example 10 | B1104 Example 11 | B1105 Example 12 | B1106 Example 13 | B1107 Example 14 | B1108 Example 15 | B1109 Example 16 | B1110 Example 17 |
| Layer thickness of second layer (μ) | 10 | 10 | 20 | 15 | 20 | 15 | 10 | 10 | 10 | 10 |
| Evaluation | | | | | | | | | | |

: Excellent
: Good

TABLE 13B

| Layer constitution | Gases employed | Flow rate (SCCM) | Flow rate ratio | Discharging power ($W/cm^2$) | Layer formation speed (Å/sec) |
|---|---|---|---|---|---|
| Second layer | $SiH_4$/He = 0.5 $PH_3$/He = | $SiH_4$ = 200 | $PH_3SiH_4$ = $1 \times 10^{-7}$ | 0.18 | 15 |

TABLE 13B-continued

| Layer constitution | Gases employed | Flow rate (SCCM) | Flow rate ratio | Discharging power (W/cm$^2$) | Layer formation speed (Å/sec) |
|---|---|---|---|---|---|
| | $10^{-3}$ | | | | |

TABLE 14B

| | Sample No. | | | | | | | | | |
|---|---|---|---|---|---|---|---|---|---|---|
| First layer | B1201 Example 8 | B1202 Example 9 | B1203 Example 10 | B1204 Example 11 | B1205 Example 12 | B1206 Example 13 | B1207 Example 14 | B1208 Example 15 | B1209 Example 16 | B1210 Example 17 |
| Layer thickness of second layer (μ) | 10 | 10 | 20 | 15 | 20 | 15 | 10 | 10 | 10 | 10 |
| Evaluation | | | | | | | | | | |

: Excellent
: Good

TABLE 1C

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer | $SiH_4/He$ = 0.05<br>$GeH_4/He$ = 0.05<br>$B_2H_6/He$ = $10^{-3}$ | $SiH_4 + GeH_4$ = 50 | $GeH_4/SiH_4$ = 3/10<br>$B_2H_6/(GeH_4 + SiH_4) = 3 \times 10^{-3}$ | 0.18 | 5 | 1 |
| Second layer | $SiH_4/He$ = 0.5 | $SiH_4$ = 200 | | 0.18 | 15 | 20 |

TABLE 2C

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer | $SiH_4/He$ = 0.05<br>$GeH_4/He$ = 0.05<br>$B_2H_6He$ = $10^{-3}$ | $SiH_4 + GeH_4$ = 50 | $GeH_4/SiH_4$ = 1/10<br>$B_2H_6/(GeH_4 + SiH_4)$ = $3 \times 10^{-3}$ | 0.18 | 5 | 1 |
| Second layer | $SiH_4/He$ = 0.05<br>$GeH_4/He$ = 0.05 | $SiH_4 + GeH_4$ = 50 | $GeH_4/SiH_4$ = 1/10 | 0.18 | 5 | 19 |
| Third layer | $SiH_4/He$ = 0.5 | $SiH_4$ = 200 | | 0.18 | 15 | 5 |

TABLE 3C

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer | $SiH_4/He$ = 0.05<br>$GeH_4/He$ = 0.05<br>$B_2H_6/He$ = $10^{-3}$ | $SiH_4 + GeH_4$ = 50 | $GeH_4/SiH_4$ = 3/10<br>$B_2H_6/(GeH_4 + SiH_4)$ = $5 \times 10^{-3}$ | 0.18 | 5 | 2 |
| Second layer | $SiH_4/He$ = 0.5<br>$B_2H_6/He$ = $10^{-3}$ | $SiH_4$ = 200 | $B_2H_6/SiH_4$ = $2 \times 10^{-4}$ | 0.18 | 15 | 20 |

TABLE 4C

| Sample No. | C401 | C402 | C403 | C404 | C405 | C406 | C407 | C408 |
|---|---|---|---|---|---|---|---|---|
| $GeH_4/SiH_4$ Flow rate ratio | 5/100 | 1/10 | 2/10 | 4/10 | 5/10 | 7/10 | 8/10 | 1/1 |
| Ge content (atomic %) | 4.3 | 8.4 | 15.4 | 26.7 | 32.3 | 38.9 | 42 | 47.6 |
| Evaluation | | | | | | | | |

: Excellent

TABLE 5C

| Sample No. | C501 | C502 | C503 | C504 | C505 | C506 | C507 | C508 |
|---|---|---|---|---|---|---|---|---|
| Layer thickness | 30Å | 500Å | 0.1μ | 0.3μ | 0.8μ | 3μ | 4μ | 5μ |
| Evaluation | Δ | | | | | | | Δ |

: Excellent
: Good
Δ: Practically satisfactory

TABLE 6C

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05 $GeH_4/He$ = 0.05 $B_2H_6/He$ = $10^{-3}$ | $SiH_4 + GeH_4$ = 50 | $GeH_4/SiH_4$ = 5/10 $B_2H_6/(GeH_4 + SiH_4)$ = $5 \times 10^{-3}$ | 0.18 | 5 | 2 |
| Second layer | $SiH_4/He$ = 0.5 $PH_3/He$ = $10^{-3}$ | $SiH_4$ = 200 | $Ph_3/SiH_4$ = $9 \times 10^{-5}$ | 0.18 | 15 | 20 |

TABLE 7C

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05 $GeH_4/He$ = 0.05 $B_2H_6/He$ = $10^{-3}$ | $SiH_4 + GeH_4$ = 50 | $GeH_4/SiH_4$ = 5/10 $B_2H_6/(GeH_4 + SiH_4)$ = $8 \times 10^{-4}$ | 0.18 | 5 | 15 |
| Second layer | $SiH_4/He$ = 0.5 $PH_3/He$ = $10^{-3}$ | $SiH_4$ = 200 | $PH_3/SiH_4$ = $1 \times 10^{-5}$ | 0.18 | 15 | 5 |

TABLE 8C

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05 $GeH_4/He$ = 0.05 $B_2H_6/He$ = $10^{-3}$ | $SiH_4 + GeH_4$ = 50 | $GeH_4/SiH_4$ = 3/10 $B_2H_6/(GeH_4 + SiH_4)$ = $9 \times 10^{-4}$ | 0.18 | 5 | 1 |
| Second layer | $SiH_4He$ = 0.5 $B_2H_6/He$ = $10^{-3}$ | $SiH_4$ = 200 | $B_2H_6SiH_4$ = $9 \times 10^{-4}$ | 0.18 | 15 | 15 |

: Good

TABLE 9C

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4He$ = 0.05 $GeH_4/He$ = 0.05 $B_2H_6/He$ = $10^{-3}$ | $SiH_4 + GeH_4$ = 50 | $GeH_4/SiH_4$ = 1/10 $B_2H_6/(GeH_4 + SiH_4)$ = $9 \times 10^{-4}$ | 0.18 | 5 | 15 |
| Second layer | $SiH_4/He$ = 0.5 $B_2H_6/He$ = | $SiH_4$ = 200 | $B_2H_6/SiH_4$ = $9 \times 10^{-4}$ | 0.18 | 15 | 5 |

TABLE 9C-continued

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| | $10^{-3}$ | | | | | |

TABLE 10C

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05 $GeH_4/He$ = 0.05 $B_2H_6/He$ = $10^{-3}$ | $SiH_4 + GeH_4$ = 50 | $GeH_4/SiH_4$ = 3/10 $B_2H_6/(GeH_4 + SiH_4)$ = $2 \times 10^{-4}$ | 0.18 | 5 | 2 |
| Second layer | $SiH_4/He$ = 0.5 $B_2H_6/He$ = $10^{-3}$ | $SiH_4$ = 200 | $B_2H_6/SiH_4$ = $2 \times 10^{-4}$ | 0.18 | 15 | 20 |

TABLE 1D

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05 $GeH_4/He$ = 0.05 $B_2H_6/He$ = $10^{-3}$ | $SiH_4 + GeH_4$ = 50 | $GeH_4/SiH_4$ = 4/10~0 $B_2H_6/(GeH_4 + SiH_4)$ = $3 \times 10^{-3}$ | 0.18 | 5 | 1 |
| Second layer | $SiH_4/He$ = 0.5 | $SiH_4$ = 200 | | 0.18 | 15 | 19 |

TABLE 2D

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05 $GeH_4/He$ = 0.05 $B_2H_6/He$ = $10^{-3}$ | $SiH_4 + GeH_4$ = 50 | $GeH_4/SiH_4$ = 1/10~0 $B_2H_6/(GeH_4 + SiH_4)$ = $1 \times 10^{-3}$ | 0.18 | 5 | 2 |
| Second layer | $SiH_4/He$ = 0.5 | $SiH_4$ = 200 | | 0.18 | 15 | 15 |

TABLE 3D

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05 $GeH_4/He$ = 0.05 $B_2H_6/He$ = $10^{-3}$ | $SiH_4 + GeH_4$ = 50 | $GeH_4/SiH_4$ = 4/10~2/1000 $B_2H_6/(GeH_4 + SiH_4)$ = $1 \times 10^{-3}$ | 0.18 | 5 | 2 |
| Second layer | $SiH_4/He$ 0.5 | $SiH_4$ = 200 | | 0.18 | 15 | 15 |

TABLE 4D

| Layer constitution | Gases employed | Flow rate (SCCM) | Flow rate ratio | Discharging power ($W/cm^2$) | Layer formation speed (Å/sec) | Layer thickness ($\mu$) |
|---|---|---|---|---|---|---|
| First layer | $SiH_4/He$ = 0.05 $GeH_4/He$ 0.05 $B_2H_6/He$ = $10^{-3}$ | $SiH_4 + GeH_4$ = 50 | $GeH_4/SiH_4$ = 15/100~0 $B_2H_6/(GeH_4 + SiH_4)$ = $3 \times 10^{-3}$ | 0.18 | 5 | 1 |
| Second layer | $SiH_4/He$ = 0.5 | $SiH_4$ = 200 | | 0.18 | 15 | 15 |

TABLE 5D

| Layer constitution | Gases employed | Flow rate (SCCM) | Flow rate ratio | Discharging power ($W/cm^2$) | Layer formation speed (Å/sec) | Layer thickness ($\mu$) |
|---|---|---|---|---|---|---|
| First layer | $SiH_4/He$ = 0.05 $GeH_4/He$ = 0.05 $B_2H_6/He$ = $10^{-3}$ | $SiH_4 + GeH_4$ = 50 | $GeH_4/SiH_4$ = 1~5/100 $B_2H_6/(GeH_4 + SiH_4)$ = $3 \times 10^{-4}$ | 0.18 | 5 | 1 |
| Second layer | $SiH_4/He$ = 0.5 | $SiH_4$ = 200 | | 0.18 | 15 | 15 |

TABLE 6D

| Layer constitution | Gases employed | Flow rate (SCCM) | Flow rate ratio | Discharging power ($W/cm^2$) | Layer formation speed (Å/sec) | Layer thickness ($\mu$) |
|---|---|---|---|---|---|---|
| First layer | $SiH_4/He$ = 0.05 $GeH_4/He$ = 0.05 $B_2H_6/He$ = $10^{-3}$ | $SiH_4 + GeH_4$ = 50 | $GeH_4/SiH_4$ = 2/10 ~ 0 $B_2H_6/(GeH_4 + SiH_4)$ = $3 \times 10^{-3}$ | 0.18 | 5 | 1 |
| Second layer | $SiH_4/He$ = 0.5 | $SiH_4$ = 200 | | 0.18 | 15 | 15 |

TABLE 7D

| Layer constitution | Gases employed | Flow rate (SCCM) | Flow rate ratio | Discharging power ($W/cm^2$) | Layer formation speed (Å/sec) | Layer thickness ($\mu$) |
|---|---|---|---|---|---|---|
| First layer | $SiH_4/He$ = 0.05 $GeH_4/He$ = 0.05 $B_2H_6/He$ = $10^{-3}$ | $SiH_4 + GeH_4$ = 50 | $GeH_4/SiH_4$ = 1/10~0 $B_2H_6/(GeH_4 + SiH_4)$ = $1 \times 10^{-3}$ | 0.18 | 5 | 1 |
| Second layer | $SiH_4/He$ = 0.5 | $SiH_4$ = 200 | | 0.18 | 15 | 15 |

TABLE 8D

| Layer constitution | Gases employed | Flow rate (SCCM) | Flow rate ratio | Discharging power ($W/cm^2$) | Layer formation speed (Å/sec) | Layer thickness ($\mu$) |
|---|---|---|---|---|---|---|
| First layer | $Si_2H_6/He$ = 0.05 $GeH_4/He$ = 0.05 $B_2H_6/He$ = $10^{-3}$ | $Si_2H_6 + GeH_4$ = 50 | $GeH_4/Si_2H_6$ = 4/10~0 $B_2H_6/(GeH_4 + Si_2H_6)$ = $3 \times 10^{-3}$ | 0.18 | 5 | 1 |
| Second layer | $Si_2H_6/He$ = 0.5 | $Si_2H_6$ = 200 | | 0.18 | 15 | 19 |

TABLE 9D

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiF_4/He$ = 0.05 $GeH_4/He$ = 0.05 $B_2H_6/He$ = $10^{-3}$ | $SiF_4 + GeH_4$ = 50 | $GeH_4/SiF_4$ = 4/10~0 $B_2H_6/(GeH_4 + SiF_4)$ $1 \times 10^{-3}$ | 0.18 | 5 | 1 |
| Second layer | $SiF_4/He$ = 0.5 | $SiF_4$ = 200 | | 0.18 | 15 | 19 |

TABLE 10D

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05 $SiF_4/He$ = 0.05 $GeH_4/He$ = 0.05 $B_2H_6/He$ = $10^{-3}$ | $SiH_4 + SiF_4 + GeH_4$ = 50 | $GeH_4/(SiH_4 + SiF_4)$ = 4/10~0 $B_2H_6/(GeH_4 + SiH_4 + SiF_4)$ = $3 \times 10^{-3}$ | 0.18 | 5 | 1 |
| Second layer | $SiH_4/He$ = 0.5 $SiF_4/He$ = 0.5 | $SiH_4 + SiF_4$ = 200 | | 0.18 | 15 | 19 |

TABLE 11D

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05 $GeH_4/He$ = 0.05 $B_2H_6/He$ = $10^{-3}$ | $SiH_4 + SiH_4$ = 50 | $GeH_4/SiH_4$ = 4/10~0 $B_2H_6/(GeH_4 + SiH_4)$ = $5 \times 10^{-4}$ | 0.18 | 5 | 1 |
| Second layer | $SiH_4/He$ = 0.5 $B_2H_6/He$ = $10^{-3}$ | $SiH_4$ = 200 | $B_2H_6/SiH_4$ = $5 \times 10^{-4}$ | 0.18 | 15 | 15 |

TABLE 12D

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05 $GeH_4/He$ = 0.05 $B_2H_6He$ = $10^{-3}$ | $SiH_4 + GeH_4$ = 50 | $GeH_4/SiH_4$ = 4/10~0 $B_2H_6/(GeH_4 + SiH_4)$ = $3 \times 10^{-3}$ | 0.18 | 5 | 1 |
| Second layer | $SiH_4/He$ = 0.5 $B_2H_6/He$ = $10^{-3}$ | $SiH_4$ = 200 | $B_2H_6/SiH_4$ = $5 \times 10^{-4}$ | 0.18 | 15 | 15 |

TABLE 13D

| layer constitution | Gases employed | Flow rate (SCCM) | Flow rate ratio | Discharging power ($W/cm^2$) | Layer formation speed (Å/sec) |
|---|---|---|---|---|---|
| Second layer | $SiH_4/He$ = 0.5 $B_2H_6/He$ = | $SiH_4$ = 200 | $B_2H_6/SiH_4$ = $1 \times 10^{-4}$ | 0.18 | 15 |

TABLE 13D-continued

| layer constitution | Gases employed | Flow rate (SCCM) | Flow rate ratio | Discharging power (W/cm$^2$) | Layer formation speed (Å/sec) |
|---|---|---|---|---|---|
| | $10^{-3}$ | | | | |

TABLE 14D

| | Sample No. | | | | | | | | | |
|---|---|---|---|---|---|---|---|---|---|---|
| First layer | D1301 Example 32 | D1302 Example 33 | D1303 Example 34 | D1304 Example 35 | D1305 Example 36 | D1306 Example 37 | D1307 Example 38 | D1308 Example 39 | D1309 Example 40 | D1310 Example 41 |
| Layer thickness of second layer (μ) | 19 | 15 | 15 | 15 | 15 | 15 | 15 | 19 | 19 | 19 |
| Evaluation | | | | | | | | | | |

: Excellent
: Good

TABLE 15D

| Layer constitution | Gases employed | Flow rate (SCCM) | Flow rate ratio | Discharging power (W/cm$^2$) | Layer formation speed (Å/sec) |
|---|---|---|---|---|---|
| Second layer | $SiH_4/He = 0.5$<br>$PH_3/He = 10^{-3}$ | $SiH_4 = 200$ | $PH_3/SiH_4 = 9 \times 10^{-5}$ | 0.18 | 15 |

TABLE 16D

| | Sample No. | | | | | | | | | |
|---|---|---|---|---|---|---|---|---|---|---|
| First layer | D1401 Example 32 | D1402 Example 33 | D1403 Example 34 | D1404 Example 35 | D1405 Example 36 | D1406 Example 37 | D1407 Example 38 | D1408 Example 39 | D1409 Example 40 | D1410 Example 41 |
| Layer thickness of second layer (μ) | 19 | 15 | 15 | 15 | 15 | 15 | 15 | 19 | 19 | 19 |
| Evaluation | | | | | | | | | | |

: Excellent
: Good

TABLE 1E

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer | $SiH_4/He = 0.05$<br>$GeH_4/He = 0.05$<br>NO | $SiH_4 + GeH_4 = 50$ | $GeH_4/SiH_4 = 1/1$<br>$NO/(GeH_4 + SiH_4) = 2/100$ | 0.18 | 5 | 3 |
| Second layer | $SiH_4/He = 0.5$ | $SiH_4 = 200$ | | 0.18 | 15 | 15 |

TABLE 2E

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer | $SiH_4/He = 0.05$<br>$GeH_4/He = 0.05$<br>NO | $SiH_4 + GeH_4 = 50$ | $GeH_4/SiH_4 = 1/10$<br>$NO/(GeH_4 + SiH_4) = 3/100 \sim 0$ (Linearly decreased) | 0.18 | 5 | 5 |
| Second layer | $SiH_4/He = 0.05$<br>$GeH_4/He = 0.05$ | $SiH_4 + GeH_4 = 50$ | $GeH_4/SiH_4 = 1/10$ | 0.18 | 5 | 1 |
| Third | $SiH_4/He =$ | $SiH_4 = 200$ | | 0.18 | 15 | 15 |

TABLE 2E-continued

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| layer | 0.5 | | | | | |

TABLE 3E

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05<br>$GeH_4/He$ = 0.05<br>NO | $SiH_4 + GeH_4$ = 50 | $GeH_4/SiH_4$ = 4/10<br>$NO/(GeH_4 + SiH_4)$ = 2/100 | 0.18 | 5 | 2 |
| Second layer | $SiH_4/He$ = 0.5<br>NO<br>$B_2H_6/He$ = $10^{-3}$ | $SiH_4$ = 200 | $NO/SiH_4$ = 2/100<br>$B_2H_6/SiH_4$ = $1 \times 10^{-5}$ | 0.18 | 15 | 2 |
| Third layer | $SiH_4/He$ = 0.5<br>$B_2H_6/He$ = $10^{-3}$ | $SiH_4$ = 200 | $B_2H_6/SiH_4$ = $1 \times 10^{-5}$ | 0.18 | 15 | 15 |

TABLE 4E

| Sample No. | D401 | D402 | D403 | D404 | D405 | D406 | D407 |
|---|---|---|---|---|---|---|---|
| Ge content (atomic %) | 1 | 3 | 5 | 10 | 40 | 60 | 90 |
| Evaluation | Δ | | | | | | Δ |

: Excellent
: Good
Δ : Practically satisfactory

TABLE 5E

| Sample No. | D501 | D502 | D503 | D504 | D505 |
|---|---|---|---|---|---|
| Layer thickness (μ) | 0.1 | 0.5 | 1 | 2 | 5 |
| Evaluation | | | | | |

: Excellent
: Good

TABLE 6E

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05<br>$GeH_4/He$ = 0.05<br>No | $SiH_4 + GeH_4$ = 50 | $GeH_4/SiH_4$ = 4/10<br>$NO/(GeH_4 + SiH_4)$ = 2/100 | 0.18 | 5 | 2 |
| Second layer | $SiH_4/He$ = 0.5<br>$PH_3/He$ = $10^{-3}$ | $SiH_4$ = 200 | $PH_3/SiH_4$ = $1 \times 10^{-7}$ | 0.18 | 15 | 20 |

TABLE 1F

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05<br>$GeH_4/He$ = 0.05<br>NO | $SiH_4 + GeH_4$ = 50 | $GeH_4/SiH_4$ = 4/10~3/100<br>$NO/(GeH_4 + SiH_4)$ = 3/100 | 0.18 | 5 | 2 |
| Second layer | $SiH_4/He$ = 0.05<br>$GeH_4/He$ = 0.05 | $SiH_4 + GeH_4$ = 50 | $GeH_4/SiH_4$ = 3/100~0 | 0.18 | 5 | 8 |
| Third layer | $SiH_4/He$ = 0.5 | $SiH_4$ = 200 | | 0.18 | 15 | 10 |

TABLE 2F

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer | $SiH_4$/He = 0.05<br>$GeH_4$/He = 0.05<br>NO | $SiH_4$ + $GeH_4$ = 50 | $GeH_4/SiH_4$ = 1/10~4/100<br>NO/($GeH_4$ + $SiH_4$) = 3/100 | 0.18 | 5 | 5 |
| Second layer | $SiH_4$/He = 0.05<br>$GeH_4$/He = 0.05 | $SiH_4$ + $GeH_4$ = 50 | $GeH_4/SiH_4$ = 4/100~0 | 0.18 | 5 | 3 |
| Third layer | $SiH_4$/He = 0.5 | $SiH_4$ = 200 | | 0.18 | 15 | 10 |

TABLE 3F

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer | $SiH_4$/He = 0.05<br>$GeH_4$/He = 0.05<br>No | $SiH_4$ + $GeH_4$ = 50 | $GeH_4/SiH_4$ = 4/10~4/100<br>NO/($GeH_4$ + $SiH_4$) = 3/100 | 0.18 | 5 | 1 |
| Second layer | $SiH_4$/He = 0.05<br>$GeH_4$/He = 0.05 | $SiH_4$ + $GeH_4$ = 50 | $GeH_4/SiH_4$ = 4/100 | 0.18 | 5 | 1 |
| Third layer | $SiH_4$/He = 0.5 | $SiH_4$ = 200 | | 0.18 | 15 | 15 |

TABLE 4F

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer | $SiH_4$/He = 0.05<br>$GeH_4$/He = 0.05<br>NO | $SiH_4$ + $GeH_4$ = 50 | $GeH_4/SiH_4$ = 15/100~1/100<br>NO/($GeH_4$ + $SiH_4$) = 3/100 | 0.18 | 5 | 0.4 |
| Second layer | $SiH_4$/He = 0.05<br>$GeH_4$/He = 0.05 | $SiH_4$ + $GeH_4$ = 50 | $GeH_4/SiH_4$ = 1/100~0 | 0.18 | 5 | 0.6 |
| Third layer | $SiH_4$/He = 0.5 | $SiH_4$ = 200 | | 0.18 | 15 | 20 |

TABLE 5F

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer | $SiH_4$/He = 0.05<br>$GeH_4$/He = 0.05<br>NO | $SiH_4$ + $GeH_4$ = 50 | $GeH_4/SiH_4$ = 1/1~14/100<br>NO/($GeH_4$ + $SiH_4$) = 3/100 | 0.18 | 5 | 0.2 |
| Second layer | $SiH_4$/He = 0.05<br>$GeH_4$/He = 0.05 | $SiH_4$ + $GeH_4$ = 0.05 | $GeH_4/SiH_4$ = 50 | 0.18<br>14/100~0 | 5 | 0.8 |
| Third layer | $SiH_4$/He = 0.5 | $SiH_4$ = 200 | | 0.18 | 15 | 20 |

TABLE 6F

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05 $GeH_4/He$ = 0.05 NO | $SiH_4 + GeH_4$ = 50 | $GeH_4/SiH_4$ = 2/10~45/1000 NO/($GeH_4$ + $SiH_4$) = 1/100 | 0.18 | 5 | 2 |
| Second layer | $SiH_4/He$ = 0.05 $GeH_4/He$ = 0.05 | $SiH_4 + GeH_4$ = 50 | $GeH_4/SiH_4$ = 45/1000~0 | 0.18 | 5 | 6 |
| Third layer | $SiH_4/He$ = 0.5 | $SiH_4$ = 200 | | 0.18 | 15 | 10 |

TABLE 7F

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05 $GeH_4/He$ = 0.05 NO | $SiH_4 + GeH_4$ = 50 | $GeH_4/SiH_4$ = 1/10~45/1000 NO/($GeH_4$ + $SiH_4$) = 1/100 | 0.18 | 5 | 4 |
| Second layer | $SiH_4/He$ = 0.05 $GeH_4/He$ = 0.05 | $SiH_4 + GeH_4$ = 50 | $GeH_4/SiH_4$ = 45/1000~0 | 0.18 | 5 | 4 |
| Third layer | $SiH_4$ /He = 0.5 | $SiH_4$ = 200 | | 0.18 | 15 | 10 |

TABLE 8F

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $Si_2H_6/He$ = 0.05 $GeH_4/He$ = 0.05 NO | $Si_2H_6 + GeH_4$ = 50 | $GeH_4/Si_2H_6$ = 4/10~3/100 NO/($GeH_4$ + $Si_2H_6$) = 3/100 | 0.18 | 5 | 2 |
| Second layer | $Si_2H_6/He$ = 0.05 $GeH_4/He$ = 0.05 | $Si_2H_6 + GeH_4$ = 50 | $GeH_4/Si_2H_6$ = 3/100~0 | 0.18 | 5 | 8 |
| Third layer | $Si_2H_6/He$ = 0.5 | $Si_2H_6$ = 200 | | 0.18 | 15 | 10 |

TABLE 9F

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiF_4/He$ = 0.05 $GeH_4/He$ = 0.05 NO | $SiF_4 + GeH_4$ = 50 | $GeH_4/SiF_4$ = 4/10~3/100 NO/($GeH_4$ + $SiF_4$) = 3/100 | 0.18 | 5 | 2 |
| Second layer | $SiF_4/He$ = 0.05 $GeH_4/He$ = 0.05 | $SiF_4 + GeH_4$ = 50 | $GeH_4/SiF_4$ = 3/100~0 | 0.18 | 5 | 8 |
| Third layer | $SiF_4/He$ = 0.5 | $SiF_4$ = 200 | | 0.18 | 15 | 10 |

TABLE 10F

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05<br>$SiF_4/He$ = 0.05<br>$GeH_4/He$ = 0.05<br>NO | $SiH_4 + SiF_4 + GeH_4$ = 50 | $GeH_4/(SiH_4 + SiF_4)$ = 4/10~3/100<br>$NO/(GeH_4 + SiH_4 + SiF_4)$ = 3/100 | 0.18 | 5 | 2 |
| Second layer | $SiH_4/He$ = 0.05<br>$SiF_4/He$ = 0.05<br>$GeH_4/He$ = 0.05 | $SiH_4 + SiF_4 + GeH_4$ = 50 | $GeH_4/(SiH_4 + SiF_4)$ = 3/100~0 | 0.18 | 5 | 8 |
| Third layer | $SiH_4/He$ = 0.5<br>$SiF_4/He$ = 0.5 | $SiH_4 + SiF_4$ = 200 | | 0.18 | 15 | 10 |

TABLE 11F

| Layer constitution | Gases employed | Flow rate (SCCM) | Flow rate ratio | Discharging power ($W/cm^2$) | Layer formation speed (Å/sec) |
|---|---|---|---|---|---|
| Third layer | $SiH_4/He$ = 0.5<br>$B_2H_6/He = 10^{-3}$ | $SiH_4$ = 200 | $B_2H_6/SiH_4 = 4 \times 10^{-4}$ | 0.18 | 15 |

TABLE 12F

| | Sample No. | | | | | | | | | |
|---|---|---|---|---|---|---|---|---|---|---|
| First layer | F1101 Example 54 | F1102 Example 55 | F1103 Example 56 | F1104 Example 57 | F1105 Example 58 | F1106 Example 59 | F1107 Example 60 | F1108 Example 61 | F1109 Example 62 | F1110 Example 63 |
| Layer thickness of second layer (μ) | 10 | 10 | 15 | 20 | 20 | 10 | 10 | 10 | 10 | 10 |
| Evaluation | | | | | | | | | | |

: Excellent
: Good

TABLE 13F

| Layer constitution | Gases employed | Flow rate (SCCM) | Flow rate ratio | Discharging power ($W/cm^2$) | Layer formation speed (Å/sec) |
|---|---|---|---|---|---|
| Third layer | $SiH_4/He$ = 0.5<br>$PH_3/He = 10^{-3}$ | $SiH_4$ = 200 | $PH_3/SiH_4 = 2 \times 10^{-5}$ | 0.18 | 15 |

TABLE 14F

| | Sample No. | | | | | | | | | |
|---|---|---|---|---|---|---|---|---|---|---|
| First layer | F1201 Example 54 | F1202 Example 55 | 1203 Example 56 | F1204 Example 57 | F1205 Example 58 | F1206 Example 59 | F1207 Example 60 | F1208 Example 61 | F1209 Example 62 | F1210 Example 63 |
| Layer thickness of third layer (μ) | 10 | 10 | 15 | 20 | 20 | 10 | 10 | 10 | 10 | 10 |
| Evaluation | | | | | | | | | | |

: Excellent
: Good

TABLE 15F

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05<br>$GeH_4/He$ = 0.05 | $SiH_4 + GeH_4$ = 50 | $GeH_4/SiH_4$ = 3/10~0<br>$NO/SiH_4$ = 4/10~2/100 | 0.18 | 5 | 2 |

TABLE 15F-continued

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| Second layer | NO $SiH_4$/He = 0.5 NO | $SiH_4$ = 200 | NO/$SiH_4$ = 2/100~0 | 0.18 | 15 | 2 |
| Third layer | $SiH_4$/He = 0.5 | $SiH_4$ = 200 | | 0.18 | 15 | 15 |

TABLE 16F

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4$/He = 0.05 $GeH_4$/He = 0.05 NO | $SiH_4$ + $GeH_4$ = 50 | $GeH_4$/$SiH_4$ = 3/10~0 NO/$SiH_4$ = 1/10~5/100 | 0.18 | 5 | 1 |
| Second layer | $SiH_4$/He = 0.5 NO | $SiH_4$ = 200 | NO/$SiH_4$ = 5/100~0 | 0.18 | 15 | 1 |
| Third layer | $SiH_4$/He = 0.5 | $SiH_4$ = 200 | | 0.18 | 15 | 18 |

TABLE 1G

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4$/He = 0.05 $GeH_4$/He = 0.05 $B_2H_6$/He = $10^{-3}$ NO | $SiH_4$ + $GeH_4$ = 50 | $GeH_4$/$SiH_4$ = 3/10 $B_2H_6$/($GeH_4$ + $SiH_4$) = $3 \times 10^{-3}$ NO/($GeH_4$ + $SiH_4$) = 3/100 | 0.18 | 5 | 1 |
| Second layer | $SiH_4$/He = 0.5 | $SiH_4$ = 200 | | 0.18 | 15 | 20 |

TABLE 2G

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4$/He = 0.05 $GeH_4$/He = 0.05 $B_2H_6$/He = $10^{-3}$ NO | $SiH_4$ + $GeH_4$ = 50 | $GeH_4$/$SiH_4$ = 1/10 $B_2H_6$/($GeH_4$ + $SiH_4$) = $3 \times 10^{-3}$ NO/($GeH_4$ + $SiH_4$) = 3/100 | 0.18 | 5 | 1 |
| Second layer | $SiH_4$/He = 0.05 $GeH_4$/He = 0.05 | $SiH_4$ + $GeH_4$ = 50 | $GeH_4$/$SiH_4$ = 1/10 | 0.18 | 5 | 19 |
| Third layer | $SiH_4$/He = 0.5 | $SiH_4$ = 200 | | 0.18 | 15 | 5 |

TABLE 3G

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4$/He = 0.05 $GeH_4$/He = 0.05 | $SiH_4$ + $GeH_4$ = 50 | $GeH_4$/$SiH_4$ = 3/10 $B_2H_6$/($GeH_4$ + $SiH_4$) = | 0.18 | 5 | 2 |

TABLE 3G-continued

| Layer constitution | Gases employed | Flow rate (SCCM) | Flow rate ratio | Discharging power (W/cm²) | Layer formation speed (Å/sec) | Layer thickness (μ) |
|---|---|---|---|---|---|---|
| | $B_2H_6$/He = $10^{-3}$ NO | | $5 \times 10^{-3}$ NO/($GeH_4$ + $SiH_4$) = 1/100 | | | |
| Second layer | $SiH_4$/He = 0.5 $B_2H_6$/He = $10^{-3}$ | $SiH_4$ = 200 | $B_2H_6/SiH_4 = 2 \times 10^{-4}$ | 0.18 | 15 | 20 |

TABLE 4G

| Sample No. | G401 | G402 | G403 | G404 | G405 | G406 | G407 | G408 |
|---|---|---|---|---|---|---|---|---|
| $GeH_4/SiH_4$ Flow rate ratio | 5/100 | 1/10 | 2/10 | 4/10 | 5/10 | 7/10 | 8/10 | 1/1 |
| Ge content (atomic %) | 4.3 | 8.4 | 15.4 | 26.7 | 32.3 | 38.9 | 42 | 47.6 |
| Evaluation | | | | | | | | |

: Excellent

TABLE 5G

| Sample No. | G501 | G502 | G503 | G504 | G505 | G506 | G507 | G508 |
|---|---|---|---|---|---|---|---|---|
| Layer thickness | 30Å | 500Å | 0.1μ | 0.3μ | 0.8μ | 3μ | 4μ | 5μ |
| Evaluation | Δ | | | | | | | Δ |

: Excellent
: Good
Δ: Practically satisfactory

TABLE 6G (Sample No. G601)

| Layer constitution | Gases employed | Flow rate (SCCM) | Flow rate ratio | Discharging power (W/cm²) | Layer formation speed (Å/sec) | Layer thickness (μ) |
|---|---|---|---|---|---|---|
| First layer | $SiH_4$/He = 0.05 $GeH_4$/He = 0.05 $B_2H_6$/He = $10^{-3}$ NO | $SiH_4 + GeH_4$ = 50 | $GeH_4/SiH_4$ = 5/10 $B_2H_6/(GeH_4 + SiH_4) = 5 \times 10^{-3}$ NO/($GeH_4$ + $SiH_4$) = 1/100 | 0.18 | 5 | 2 |
| Second layer | $SiH_4$/He = 0.5 $PH_3$/He = $10^{-3}$ | $SiH_4$ = 200 | $PH_3/SiH_4 = 9 \times 10^{-5}$ | 0.18 | 15 | 20 |

TABLE 7G

| Layer constitution | Gases employed | Flow rate (SCCM) | Flow rate ratio | Discharging power (W/cm²) | Layer formation speed (Å/sec) | Layer thickness (μ) |
|---|---|---|---|---|---|---|
| First layer | $SiH_4$/He = 0.05 $GeH_4$/He = 0.05 $B_2H_6$/He = $10^{-3}$ NO | $SiH_4 + GeH_4$ = 50 | $GeH_4SiH_4$ = 1/10 $B_2H_6/(GeH_4 + SiH_4) = 8 \times 10^{-4}$ NO/($GeH_4$ + $SiH_4$) = 1/100 | 0.18 | 5 | 15 |
| Second layer | $SiH_4$He = 0.5 $PH_3$/He = $10^{-3}$ | $SiH_4$ = 200 | $PH_3/SiH_4 = 1 \times 10^{-5}$ | 0.18 | 15 | 5 |

(Sample No. G602)

: Good

TABLE 8G (Sample No. G603)

| Layer constitution | Gases employed | Flow rate (SCCM) | Flow rate ratio | Discharging power (W/cm²) | Layer formation speed (Å/sec) | Layer thickness (μ) |
|---|---|---|---|---|---|---|
| First layer | $SiH_4$/He = 0.05 $GeH_4$/He = 0.05 $B_2H_6$/He = $10^{-3}$ NO | $SiH_4 + GeH_4$ = 50 | $GeH_4/SiH_4$ = 3/10 $B_2H_6/(GeH_4 + SiH_4) = 3 \times 10^{-3}$ NO/($GeH_4$ + $SiH_4$) = 3/100 | 0.18 | 5 | 1 |
| Second layer | $SiH_4$/He = 0.5 $B_2H_6$/He = $10^{-3}$ | $SiH_4$ = 200 | $B_2H_6/SiH_4 = 3 \times 10^{-4}$ | 0.18 | 15 | 20 |

TABLE 9G

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05<br>$GeH_4/He$ = 0.05<br>$B_2H_6/He$ = $10^{-3}$<br>NO | $SiH_4 + GeH_4$ = 50 | $GeH_4/SiH_4$ = 1/10<br>$B_2H_6/(GeH_4 + SiH_4)$ $1 \times 10^{-5}$<br>$NO/(GeH_4 +$ 3/100 | 0.18 | 5 | 1 |
| Second layer | $SiH_4/He$ = 0.05<br>$GeH_4/He$ = 0.05<br>$B_2H_6/He$ = $10^{-3}$ | $SiH_4 + GeH_4$ = 50<br>$1 \times 10^{-5}$ | $GeH_4/SiH_4$ = 1/10<br>$B_2H_6/(GeH_4 + SiH_4)$ = | 0.18 | 5 | 19 |
| Third layer | $SiH_4/He$ = 0.5<br>$B_2H_6/He$ = $10^{-3}$ | $SiH_4$ = 200 | $B_2H_6/SiH_4$ = $3 \times 10^{-4}$ | 0.18 | 15 | 5 |

(Sample No. G701)

TABLE 10G

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05<br>$GeH_4/He$ = 0.05<br>$B_2H_6/He$ = $10^{-3}$<br>NO | $SiH_4 + GeH_4$ = 50 | $GeH_4/SiH_4$ = 3/10<br>$B_2H_6/(GeH_4 + SiH_4)$ = $1 \times 10^{-5}$<br>$NO/SiH_4$ = 3/100 | 0.18 | 5 | 1 |
| Second layer | $SiH_4/He$ = 0.05<br>$GeH_4/He$ = 0.05<br>NO | $SiH_4 + GeH_4$ = 50 | $GeH_4/SiH_4$ = 3/10<br>$NO/SiH_4$ = 3/100 | 0.18 | 5 | 1 |
| Third layer | $SiH_4/He$ = 0.5<br>NO<br>$B_2H_6/He$ = $10^{-3}$ | $SiH_4$ = 200 | $NO/SiH_4$ = 3/100<br>$B_2H_6/SiH_4$ = $1 \times 10^{-4}$ | 0.18 | 15 | 1 |
| Fourth layer | $SiH_4/He$ = 0.5<br>$B_2H_6/He$ = $10^{-3}$ | $SiH_4$ = 200 | $B_2H_6/SiH_4$ = $1 \times 10^{-4}$ | 0.18 | 15 | 15 |

(Sample No. G702)

TABLE 11G

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05<br>$GeH_4/He$ = 0.05<br>$B_2H_6/He$ = $10^{-3}$<br>NO | $SiH_4 + GeH_4$ = 50 | $GeH_4/SiH_4$ = 3/10<br>$B_2H_6/(GeH_4 + SiH_4)$ = $3 \times 10^{-3}$<br>$NO/(GeH_4 + SiH_4)$ = 3/100~2.83/100 | 0.18 | 5 | 1 |
| Second layer | $SiH_4/He$ = 0.05<br>$GeH_4/He$ = 0.05<br>NO | $SiH_4 + GeH_4$ = 50 | $GeH_4/SiH_4$ = 3/10<br>$NO/(GeH_4 + SiH_4)$ = 2.83/100~0 | 0.18 | 5 | 1 |
| Third layer | $SiH_4He$ = 0.5 | $SiH_4$ = 200 | | 0.18 | 15 | 19 |

(Sample No. G801)

Note: $NO/(GeH_4 + SiH_4)$ was linearly decreased.

TABLE 12G

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05<br>$GeH_4/He$ = 0.05<br>$B_2H_6/He$ = $10^{-3}$<br>NO | $SiH_4 + GeH_4$ = 50 | $GeH_4/SiH_4$ = 1/10<br>$B_2H_6/(GeH_4 + SiH_4)$ = $3 \times 10^{-3}$<br>$NO/(GeH_4 +$ 3/100~0 | 0.18 | 5 | 0.5 |
| Second layer | $SiH_4/He$ = 0.05<br>$GeH_4/He$ = 0.05<br>$B_2H_6/He$ = $10^{-3}$ | $SiH_4 + GeH_4$ = 50 | $GeH_4/SiH_4$ = 1/10<br>$B_2H_6/(GeH_4 + SiH_4)$ = $3 \times 10^{-3}$ | 0.18 | 5 | 0.5 |
| Third layer | $SiH_4/He$ = 0.05<br>$GeH_4/He$ = 0.05 | $SiH_4 + GeH_4$ = 50 | $GeH_4/SiH_4$ = 1/10 | 0.18 | 5 | 19 |
| Fourth layer | $SiH_4/He$ = 0.5 | $SiH_4$ = 200 | | 0.18 | 15 | 5 |

(Sample No. G802)

TABLE 13G

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05<br>$GeH_4/He$ = 0.05<br>$B_2H_6/He$ = $10^{-3}$<br>NO | $SiH_4 + GeH_4$ = 50 | $GeH_4/SiH_4$ = 3/10<br>$B_2H_6/(GeH_4 + SiH_4)$ = $5 \times 10^{-3}$<br>$NO/(GeH_4 +$ 1/100~0 | 0.18 | 5 | 1 |
| Second layer | $SiH_4/He$ = 0.05<br>$GeH_4/He$ = 0.05<br>$B_2H_6/He$ = $10^{-3}$ | $SiH_4 + GeH_4$ = 50 | $GeH_4/SiH_4$ = 3/10<br>$B_2H_6/(GeH_4 + SiH_4)$ = $5 \times 10^{-3}$ | 0.18 | 5 | 1 |
| Third layer | $SiH_4/He$ = 0.5<br>$B_2H_6/He$ = $10^{-3}$ | $SiH_4$ = 200 | $B_2H_6/SiH_4$ = $2 \times 10^{-4}$ | 0.18 | 15 | 20 |

(Sample No. G803)

TABLE 14G

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05<br>$GeH_4/He$ = 0.05<br>$B_2H_6/He$ = $10^{-3}$<br>NO | $SiH_4 + GeH_4$ = 50 | $GeH_4/SiH_4$ = 3/10<br>$B_2H_6SiH_4$ = $3 \times 10^{-3}$<br>$NO/SiH_4$ = 3/100~ 2.83/100 | 0.18 | 5 | 1 |
| Second layer | $SiH_4/He$ = 0.5<br>NO<br>$B_2H_6/He$ = $10^{-3}$ | $SiH_4$ = 200 | $NO/SiH_4$ = 2.83~0<br>$B_2H_6/SiH_4$ = $3 \times 10^{-4}$ | 0.18 | 15 | 20 |

(Sample No. G804)

Note: $NO/SiH_4$ was linearly decreased.

TABLE 15G

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05<br>$GeH_4/He$ = 0.05<br>$B_2H_6/He$ = $10^{-3}$<br>NO | $SiH_4 + GeH_4$ = 50 | $GeH_4/SiH_4$ = 1/10<br>$B_2H_6/(GeH_4 + SiH_4)$ = $1 \times 10^{-5}$<br>$NO/(GeH_4 + SiH_4)$ = 3/100~0 | 0.18 | 5 | 1 |
| Second layer | $SiH_4/He$ = 0.05<br>$GeH_4/He$ = 0.05<br>$B_2H_6/He$ = $10^{-3}$ | $SiH_4 + GeH_4$ = 50<br>$1 \times 10^{-5}$ | $GeH_4/SiH_4$ = 1/10<br>$B_2H_6/(GeH_4 + SiH_4)$ = | 0.18 | 5 | 19 |
| Third layer | $SiH_4/He$ = 0.5<br>$B_2H_6/He$ = $10^{-3}$ | $SiH_4$ = 200 | $B_2H_6/SiH_4$ = $3 \times 10^{-4}$ | 0.18 | 15 | 5 |

(Sample No. G805)

Note: $NO/(GeH_4 + SiH_4)$ was linearly decreased.

TABLE 1H

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05<br>$GeH_4/He$ = 0.05<br>$B_2H_6/He$ = $10^{-3}$<br>NO | $SiH_4 + GeH_4$ = 50 | $GeH_4/SiH_4$ = 4/10~0<br>$B_2H_6/(GeH_4 + SiH_4)$ = $3 \times 10^{-3}$<br>$NO/(GeH_4 + SiH_4)$ = 3/100 | 0.18 | 5 | 1 |
| Second layer | $SiH_4/He$ = 0.5 | $SiH_4$ = 200 | | 0.18 | 15 | 19 |

TABLE 2H

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05<br>$GeH_4/He$ = 0.05<br>$B_2H_6/He$ = $10^{-3}$<br>NO | $SiH_4 + GeH_4$ = 50 | $GeH_4/SiH_4$ = 1/10~0<br>$B_2H_6/(GeH_4 + SiH_4)$ = $1 \times 10^{-3}$<br>$NO/(GeH_4 + SiH_4)$ = 1/100 | 0.18 | 5 | 2 |
| Second layer | $SiH_4/He$ = 0.5 | $SiH_4$ = 200 | | 0.18 | 15 | 15 |

TABLE 3H

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He$ = 0.05<br>$GeH_4/He$ = 0.05<br>$B_2H_6/He$ = $10^{-3}$<br>NO | $SiH_4 + GeH_4$ = 50 | $GeH_4/SiH_4$ = 4/10~2/1000<br>$B_2H_6/(GeH_4 + SiH_4)$ = $1 \times 10^{-3}$<br>$NO/(GeH_4 + SiH_4)$ = 1/100 | 0.18 | 5 | 2 |
| Second layer | $SiH_4/He$ = 0.5 | $SiH_4$ = 200 | | 0.18 | 15 | 15 |

TABLE 4H

| Layer constitution | Gases employed | Flow rate (SCCM) | Flow rate ratio | Discharging power ($W/cm^2$) | Layer formation speed (Å/sec) | Layer thickness ($\mu$) |
|---|---|---|---|---|---|---|
| First layer | $SiH_4/He$ = 0.05 $GeH_4/He$ = 0.05 $B_2H_6/He$ = $10^{-3}$ NO | $SiH_4 + GeH_4$ = 50 | $GeH_4/SiH_4$ = 15/100~0 $B_2H_6/(GeH_4 + SiH_4)$ = $3 \times 10^{-3}$ $NO/GeH_4 + SiH_4)$ = 2/100 | 0.18 | 5 | 1 |
| Second layer | $SiH_4/He$ = 0.5 | $SiH_4$ = 200 | | 0.18 | 15 | 15 |

TABLE 5H

| Layer constitution | Gases employed | Flow rate (SCCM) | Flow rate ratio | Discharging power ($W/cm^2$) | Layer formation speed (Å/sec) | Layer thickness ($\mu$) |
|---|---|---|---|---|---|---|
| First layer | $SiH_4/He$ = 0.05 $GeH_4/He$ = 0.05 $B_2H_6/He$ = $10^{-3}$ NO | $SiH_4 + GeH_4$ = 50 | $GeH_4/SiH_4$ = 1/1~5/100 $B_2H_6/(GeH_4 + SiH_4)$ = $3 \times 10^{-3}$ $NO/(GeH_4 + SiH_4)$ = 2/100 | 0.18 | 5 | 1 |
| Second layer | $SiH_4/He$ = 0.5 | $SiH_4$ = 200 | | 0.18 | 15 | 15 |

TABLE 6H

| Layer constitution | Gases employed | Flow rate (SCCM) | Flow rate ratio | Discharging power ($W/cm^2$) | Layer formation speed (Å/sec) | Layer thickness ($\mu$) |
|---|---|---|---|---|---|---|
| First layer | $SiH_4/He$ = 0.05 $GeH_4/He$ = 0.05 $B_2H_6/He$ = $10^{-3}$ NO | $SiH_4 + GeH_4$ = 50 | $GeH_4/SiH_4$ = 2/10~0 $B_2H_6/(GeH_4 + SiH_4)$ = $3 \times 10^{-3}$ $NO/(GeH_4 + SiH_4)$ = 2/100 | 0.18 | 5 | 1 |
| Second layer | $SiH_4/He$ = 0.5 | $SiH_4$ = 200 | | 0.18 | 15 | 15 |

TABLE 7H

| Layer constitution | Gases employed | Flow rate (SCCM) | Flow rate ratio | Discharging power ($W/cm^2$) | Layer formation speed (Å/sec) | Layer thickness ($\mu$) |
|---|---|---|---|---|---|---|
| First layer | $SiH_4/He$ = 0.05 $GeH_4/He$ = 0.05 $B_2H_6/He$ = $10^{-3}$ NO | $SiH_4 + GeH_4$ = 50 | $GeH_4/SiH_4$ = 1/10~0 $B_2H_6/(GeH_4 + SiH_4)$ = $3 \times 10^{-3}$ $NO/(GeH_4 + SiH_4)$ = 2/100 | 0.18 | 5 | 1 |
| Second layer | $SiH_4/He$ = 0.5 | $SiH_4$ = 200 | | 0.18 | 15 | 15 |

TABLE 8H

| Layer constitution | Gases employed | Flow rate (SCCM) | Flow rate ratio | Discharging power ($W/cm^2$) | Layer formation speed (Å/sec) | Layer thickness ($\mu$) |
|---|---|---|---|---|---|---|
| First layer | $Si_2H_6/He$ = 0.05 $GeH_4/He$ = 0.05 | $Si_2H_6 + GeH_4$ = 50 | $GeH_4/Si_2H_6$ = 4/10~0 $B_2H_6/(GeH_4 + Si_2H_6)$ = | 0.18 | 5 | 1 |

TABLE 8H-continued

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| | $B_2H_6/He = 10^{-3}$ NO | | $3 \times 10^{-3}$ $NO/(GeH_4 + Si_2H_6) = 2/100$ | | | |
| Second layer | $Si_2H_6/He = 0.5$ | $Si_2H_6 = 200$ | | 0.18 | 15 | 19 |

TABLE 9H

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiF_4/He = 0.05$ $GeH_4/He = 0.05$ $B_2H_6/He = 10^{-3}$ NO | $SiF_4 + GeH_4 = 50$ | $GeH_4/SiF_4 = 4/10 \sim 0$ $B_2H_6/(GeH_4 + SiF_4) = 3 \times 10^{-3}$ $NO/(GeH_4 + SiF_4) = 1/100$ | 0.18 | 5 | 1 |
| Second layer | $SiF_4/He = 0.05$ | $SiF_4 = 200$ | | 0.18 | 5 | 19 |

TABLE 10H

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He = 0.05$ $SiF_4/He = 0.05$ $GeH_4/He = 0.05$ $B_2H_6/He = 10^{-3}$ NO | $SiH_4 + SiF_4 + GeH_4 = 50$ | $GeH_4/(SiH_4 + SiF_4) = 4/10 \sim 0$ $B_2H_6/(GeH_4 + SiH_4 + SiF_4) = 3 \times 10^{-3}$ $NO/(GeH_4 + SiH_4 + SiF_4) = 1/100$ | 0.18 | 5 | 1 |
| Second layer | $SiH_4/He = 0.5$ $SiF_4/He = 0.5$ | $SiH_4 + SiF_4 = 200$ | | 0.18 | 5 | 19 |

TABLE 11H

| Layer constitution | Gases employed | Flow rate (SCCM) | Flow rate ratio | Discharging power ($W/cm^2$) | Layer formation speed (Å/sec) | Layer thickness (μ) |
|---|---|---|---|---|---|---|
| First layer | $SiH_4/He = 0.05$ $GeH_4/He = 0.05$ $B_2H_6/He = 10^{-3}$ NO | $SiH_4 + GeH_4 = 50$ | $GeH_4/SiH_4 = 4/10 \sim 0$ $B_2H_6/(GeH_4 + SiH_4) = 3 \times 10^{-3}$ $NO/(GeH_4 + SiH_4) = 3/100$ | 0.18 | 5 | 1 |
| Second layer | $SiH_4/He = 0.5$ $B_2H_6/He = 10^{-3}$ | $SiH_4 = 200$ | $B_2H_6/SiH_4 = 3 \times 10^{-3}$ | 0.18 | 15 | 19 |

TABLE 12H

| Sample No. | H1201 | H1202 | H1203 | H1204 | H1205 | H1206 | H1207 | H1208 |
|---|---|---|---|---|---|---|---|---|
| $B_2H_6/SiH_4$ Flow rate ratio | $1 \times 10^{-2}$ | $5 \times 10^{-3}$ | $2 \times 10^{-3}$ | $1 \times 10^{-3}$ | $8 \times 10^{-4}$ | $5 \times 10^{-4}$ | $3 \times 10^{-4}$ | $1 \times 10^{-4}$ |
| B content (atom ppm) | $1 \times 10^4$ | $6 \times 10^3$ | $25 \times 10^3$ | $1 \times 10^3$ | 800 | 500 | 300 | 100 |

TABLE 12H-continued

| Sample No. | H1201 | H1202 | H1203 | H1204 | H1205 | H1206 | H1207 | H1208 |
|---|---|---|---|---|---|---|---|---|
| Evaluation | | | | | | | | |

: Excellent
: Good

TABLE 13H

| Layer constitution | Gases employed | Flow rate (SCCM) | Flow rate ratio | Discharging power ($W/cm^2$) | Layer formation speed (Å/sec) |
|---|---|---|---|---|---|
| Second layer | $SiH_4/He = 0.5$<br>$B_2H_6/He = 10^{-3}$ | $SiH_4 = 200$ | $B_2H_6/SiH_4 = 8 \times 10^{-5}$ | 0.18 | 15 |

TABLE 14H

| | Sample No. | | | | | | | | | |
|---|---|---|---|---|---|---|---|---|---|---|
| First layer | H1301 Example 78 | H1302 Example 79 | H1303 Example 80 | H1304 Example 81 | H1305 Example 82 | H1306 Example 83 | H1307 Example 84 | H1308 Example 85 | H1309 Example 86 | H1310 Example 87 |
| Layer thickness of second layer (μ) | 10 | 10 | 20 | 15 | 20 | 15 | 10 | 10 | 10 | 10 |
| Evaluation | | | | | | | | | | |

: Excellent
: Good

TABLE 15H

| Layer constitution | Gases employed | Flow rate (SCCM) | Flow rate ratio | Discharging powder ($W/cm^2$) | Layer formation speed (Å/sec) |
|---|---|---|---|---|---|
| Second layer | $SiH_4/He = 0.5$<br>$PH_3/He = 10^{-3}$ | $SiH_4 = 200$ | $PH_3/SiH_4 = 1 \times 10^{-5}$ | 0.18 | 15 |

TABLE 16H

| | Sample No. | | | | | | | | | |
|---|---|---|---|---|---|---|---|---|---|---|
| First layer | H1401 Example 78 | H1402 Example 79 | H1403 Example 80 | H1404 Example ·81 | H1405 Example 82 | H1406 Example 83 | H1407 Example 84 | H1408 Example 85 | H1409 Example 86 | H1410 Example 87 |
| Layer thickness of second layer (μ) | 10 | 10 | 20 | 15 | 20 | 15 | 10 | 10 | 10 | 10 |
| Evaluation | | | | | | | | | | |

: Excellent
: Good

We claim:

1. A photoconductive member comprising a support and an amorphous layer having a layer constitution comprising a first layer region comprising an amorphous material containing silicon atoms, $1-9.5 \times 10^5$ atomic ppm of germanium atoms and 0.01–40 atomic % of at least one of hydrogen atoms and halogen atoms, and having a layer thickness of 30 Å–50μ, and a second layer region comprising an amorphous material containing silicon atoms and 1–40 atomic % of at least one of hydrogen atoms and halogen atoms, and having a layer thickness of 0.5–90μ and exhibiting photoconductivity, said first and second layer regions being provided successively from the side of said support.

2. A photoconductive member according to claim 1, wherein the first layer region contains a substance for controlling the conduction characteristics.

3. A photoconductive member according to claim 2, wherein the substance for controlling the conduction characteristics is an atom belonging to the grup III of the periodic table.

4. A photoconductive member according to claim 3, wherein the atom belonging to the group III of the periodic table is selected from the group consisting of B, Al, Ga, In and Tl.

5. A photoconductive member according to claim 3, wherein the substance for controlling the conduction characteristics is a P-type purity.

6. A photoconductive member according to claim 2, wherein the substance for controlling the conduction characteristics is an atom belonging to the group V of the periodic table.

7. A photoconductive member according to claim 6, wherein the atom belonging to the group V of the periodic table is selected from the group consisting of P, Aa, Sb and Bi.

8. A photoconductive member according to claim 2, wherein the substance for controlling the conduction characteristics is an N-type purity.

9. A photoconductive member according to claim 1, wherein the amorphous layer contains a substance for controlling the conduction characteristics.

10. A photoconductive member according to claim 9, wherein the substance for controlling the conduction characteristics is a P-type purity.

11. A photoconductive member according to claim 9, wherein the substance for controlling the conduction characteristics is an N-type purity.

12. A photoconductive member according to claim 9, wherein the substance for controlling the conduction characteristics is an atom belonging to the group III of the periodic table.

13. A photoconductive member according to claim 12, wherein the atom belonging to the group III of the periodic table is selected from the group consisting of B, Al, Ga, In and Tl.

14. A photoconductive member according to claim 9, wherein the substance for controlling the conduction characteristics is an atom belonging to the group V of the periodic table.

15. A photoconductive member according to claim 14, wherein the atom belonging to the group V of the periodic table is selected from the group consisting of P, As, Sb and Bi.

16. A photoconductive member according to claim 9, wherein the amorphous layer has a layer region (P) containing a P-type impurity and a layer region (N) containing an N-type impurity.

17. A photoconductive member according to claim 16, wherein the layer region (P) and the layer region (N) are contacted with each other.

18. A photoconductive member according to claim 17, wherein the layer region (P) is provided as end portion layer region on the support side of the amorphous layer.

19. A photoconductive member according to claim 1, wherein the amorphous layer has a layer region containing a P-type impurity in the end portion layer region on the support side.

20. A photoconductive memboer according to claim 1, wherein the layer thickness $T_B$ of the first layer region and the layer thickness T of the second layer region has the following relation: $T_B/T$ 1.

21. A photoconductive member according to claim 1, wherein the amorphous layer contains oxygen atoms.

22. A photoconductive member according to claim 21, wherein the oxygen atoms are contained in a distribution state ununiform in the direction of layer thickness.

23. A photoconductive member according to claim 22, wherein the oxygen atoms are contained in a distribution state more enriched toward the support side.

24. A photoconductive member according to claim 1, wherein the amorphous layer contains oxygen atoms in the end portion layer region on the support side.

25. A photoconductive member comprising a support and an amorphous layer having a layer constitution comprising a first layer region comprising an amorphous material containing silicon atoms and germanium atoms and a second layer region comprising an amorphous material containing silicon atoms and exhibiting photoconductivity, said first and second layer regions being provided successively from the side of said support, said germanium atoms being distributed nonuniformly within the first layer region in the direction of the first layer region thickness.

26. A photoconductive member according to claim 25, wherein the first layer region contains a substance for controlling the conduction characteristics.

27. A photoconductive member according to claim 26 wherein the substance for controlling the conduction characteristics is an atom belonging to Group III of the periodic table.

28. A photoconductive member according to claim 27, wherein the atom belonging to Group III of the periodic table is selected from the group consisting of B, Al, Ga, In and Tl.

29. A photoconductive member according to claim 26, wherein the substance for controlling the conduction characteristics is a P-type impurity.

30. A photoconductive member according to claim 26, wherein the substance for controlling the conduction characteristics is an atom belonging to Group V of the periodic table.

31. A photoconductive member according to claim 30, wherein the atom belonging to Group V of the periodic table is selected from the group consisting of P, As, Sb and Bi.

32. A photoconductive member according to claim 26, wherein the substance for controlling the conduction characteristics is a N-type impurity.

33. A photoconductive member according to claim 25, wherein the amorphous layer contains a substance for controlling the conduction characteristics.

34. A photoconductive member according to claim 33, wherein the substance for controlling the conduction characteristics is a P-type impurity.

35. A photoconductive member according to claim 33, wherein the substance for controlling the conduction characteristics is a N-type impurity.

36. A photoconductive member according to claim 33, wherein the substance for controlling the conduction characteristics is an atom belonging to Group III of the periodic table.

37. A photoconductive member according to claim 36, wherein the atom belonging to Group III of the periodic table is selected from the group consisting of B, Al, Ga, In and Tl.

38. A photoconductive member according to claim 33, wherein the substance for controlling the conduction characteristics is an atom belonging to Group V of the periodic table.

39. A photoconductive member according to claim 38, wherein the atom belonging to Group V of the periodic table is selected from the group consisting of P, As, Sb, and Bi.

40. A photoconductive member according to claim 33, wherein the amorphous layer has a layer region (P) containing a P-type impurity and a layer region (N) containing a N-type impurity.

41. A photoconductive member according to claim 40, wherein the layer region (P) and the layer region (N) are contacted with each other.

42. A photoconductive member according to claim 41, wherein the layer region (P) is provided as an end portion layer region on the support side of the amorphous layer.

43. A photoconductive member according to claim 25, wherein the amorphous layer has a layer region containing a P-type impurity in the end portion layer region on the support side.

44. A photoconductive member according to claim 25, wherein the layer thickness $T_B$ of the first layer region and the layer thickness T of the second layer region has the following relation: $T_B/T \leqq 1$.

45. A photoconductive member according to claim 25, wherein the amorphous layer contains oxygen atoms.

46. A photoconductive member according to claim 45, wherein the oxygen atoms are contained in a nonuniform distribution state in the direction of layer thickness.

47. A photoconductive member according to claim 46, wherein the oxygen atoms are contained in a distribution state more enriched toward the support side.

48. A photoconductive member according to claim 25, wherein the amorphous layer contains oxygen atoms in the end portion layer region on the support side.

49. A photoconductive member according to claim 1, wherein the amorphous layer has a layer region (PN) containing a substance (C) for controlling the conduction characteristics.

50. A photoconductive member according to claim 49, wherein the content of said substance (C) in the layer region (PN) is $0.01\text{-}5\times10^4$ atomic ppm.

51. A photoconductive member according to claim 49, wherein the substance (C) is an atom belonging to Group III of the periodic table.

52. A photoconductive member according to claim 49, wherein the substance (C) is an atom belonging to Group V of the periodic table.

53. A photoconductive member according to claim 25, wherein the amorphous layer has a layer region (PN) containing a substance (C) for controlling the conduction characteristics.

54. A photoconductive member according to claim 53, wherein the content of said substance (C) in the layer region (PN) is $0.01\text{-}5\times10^4$ atomic ppm.

55. A photoconductive member according to claim 53, wherein the substance (C) is an atom belonging to Group III of the periodic table.

56. A photoconductive member according to claim 53, wherein the substance (C) is an atom belonging to Group V of periodic table.

* * * * *

UNITED STATES PATENT AND TRADEMARK OFFICE

CERTIFICATE OF CORRECTION

PATENT NO. : 4,490,450

DATED : December 25, 1984

INVENTOR(S) : Shimizu et al.

It is certified that error appears in the above-identified patent and that said Letters Patent is hereby corrected as shown below:

Column 1, line 49, change "for" to --For--.

Column 2, line 11, after "greater" delete --,--.

line 48, after "is" insert --an--.

line 54, delete "observed".

Column 3, line 8, after "and" insert --a--.

Column 4, line 5, change "longerwavelength" to --longer wavelength--.

line 16, change "atom." to --atoms--.

line 18, change "ununiform" to --nonuniform--.

line 28, change "ununiform" to --nonuniform--.

line 33, delete "axis of".

line 35, delete "axis of".

Column 5, lines 27-28, change "constantly" to --constant--.

line 48, change "ununiform" to --nonuniform--.

UNITED STATES PATENT AND TRADEMARK OFFICE

CERTIFICATE OF CORRECTION

PATENT NO. : 4,490,450

DATED : December 25, 1984

INVENTOR(S) : Shimizu et al.

It is certified that error appears in the above-identified patent and that said Letters Patent is hereby corrected as shown below:

lines 51-52, change "ununiform" to --nonuniform--.

line 61, change "ununiform" to --nonuniform--.

Column 6, line 31, change "one of" to --both--.

line 60, delete "be".

line 66, delete "be".

Column 8, lines 23-24, change "socalled" to --so-called--.

line 40, delete "be" second occurrence.

line 49, change "about" to --to the--.

Column 9, line 34, change "socalled" to --so-called--.

line 41, change "socalled" to --so-called--.

line 55, change "ununiform similarly" to --nonuniform similar--.

line 60, change "ununiform" to --nonuniform--.

Column 10, line 1, after "support" insert --and--.

line 5, change "smaller" to --small--.

UNITED STATES PATENT AND TRADEMARK OFFICE

CERTIFICATE OF CORRECTION

PATENT NO. : 4,490,450

DATED : December 25, 1984

INVENTOR(S) : Shimizu, et al.

It is certified that error appears in the above-identified patent and that said Letters Patent is hereby corrected as shown below:

line 29, change "about" to --to the --.

line 44, delete "be".

Column 11, line 13, after "concentration" insert --is--.

line 18, after "utilizing" insert --a--.

Column 12, line 3, change "idione" to --iodine--.

line 7, change "socalled" to --so-called--.

line 10, change "photoductive" to --photoconductive--.

line 51, delete "of".

Column 13, line 13, after "containing" insert --a--.

line 50, change "[that" to --(that--.

line 51, change "(s)] to --(s))--.

Column 14, line 51, delete "of".

Column 15, line 4, change "monooxide" to --monoxide--.

line 5, change "monooxide" to --monoxide--.

line 18, after "when" insert --a--.

line 58, after "In" insert --the--.

UNITED STATES PATENT AND TRADEMARK OFFICE

CERTIFICATE OF CORRECTION

PATENT NO. : 4,490,450

DATED : December 25, 1984

INVENTOR(S) : Shimizu et al.

It is certified that error appears in the above-identified patent and that said Letters Patent is hereby corrected as shown below:

Column 16, line 2, change "previously" to --first--.

line 14, change "phlyethylene" to --polyethylene--.

line 45, after "of" insert --ease of--.

Column 17, line 15, after "permit" insert --the--.

line 39, change "atom" to --atoms--.

line 42, change "ununiform" to --nonuniform--.

line 59, change "ununiform" to --nonuniform--.

line 62, after "in" insert --the--.

Column 18, line 8, after "electrical" delete "," and insert --and--.

line 15, after "having" insert --a--.

line 45, change "KV" to --kV--.

Column 19, line 47, change "KV" to --kV--.

Column 20, line 18, change "KV" to --kV--.

Column 22, line 60, change "KV" to --kV--.

Column 23, line 65, change "KV" to --kV--.

UNITED STATES PATENT AND TRADEMARK OFFICE

CERTIFICATE OF CORRECTION

PATENT NO. : 4,490,450

DATED : December 25, 1984

INVENTOR(S) : Shimizu et al.

It is certified that error appears in the above-identified patent and that said Letters Patent is hereby corrected as shown below:

Column 24, line 20, change "KV" to --kV--.

line 44, change "KV" to --kV--.

Column 25, line 37, change "KV" to --kV--.

Column 27, line 53, change "KV" to --kV--.

Column 28, line 5, after "in" insert --the--.

line 56, change "KV" to --kV--.

Column 29, line 59, change "KV" to --kV--.

Column 30. line 30, change "KV" to --kV--.

Column 39, line 32, change ": Excellent

: Good

Δ practically satisfactory" to O: Excellent

O: Good

Δ: Practically Satisfactory--.

Column 32, line 29, before "respective" insert --the--.

line 40, before "respective" insert --the--.

Column 33, line 43, change "KV" to --kV--.

UNITED STATES PATENT AND TRADEMARK OFFICE

CERTIFICATE OF CORRECTION

PATENT NO. : 4,490,450

DATED : December 25, 1984

INVENTOR(S) : Shimizu et al.

It is certified that error appears in the above-identified patent and that said Letters Patent is hereby corrected as shown below:

Column 34, line 47, change "KV" to --kV--.

Column 35, line 43, change "KV" to --kV--.

Column 38, line 3, change "KV" to --kV--.

line 25, after "in" insert --the--.

Column 39, line 30, Table 4A, in the "Evaluation" column, insert --Δ00000Δ--.

Column 40, Table 5A, change ": Excellent"

: Good to

--O: Excellent

O: Good--.

Column 42, Table 5B, under "Layer Thickness (u)" change "2.0" to --0.8--.

Column 43, Table 12B, change ": Excellent

: Good" to

--O: Excellent

O: Good--.

UNITED STATES PATENT AND TRADEMARK OFFICE

CERTIFICATE OF CORRECTION

PATENT NO. : 4,490,450

DATED : December 25, 1984

INVENTOR(S) : Shimizu, et al.

It is certified that error appears in the above-identified patent and that said Letters Patent is hereby corrected as shown below:

Column 45, Table 14B, in the "Evaluation" column, insert across the column --OOOOOOOOOO--.

Column 47, line 8, Table 4C, change ": Excellent" to --O: Excellent

O: Good--.

Column 48, Table 5C, add --O-- under Sample C502, --O-- under C503, C505, and --O-- under C506-C507.

Column 53, Table 13D, change "layer to --Layer

| | |
|---|---|
| consti- | consti |
| tution" | tution--. |

Column 55, Table 13D, change "layer to --Layer

| | |
|---|---|
| consti- | consti |
| tution" | tution--. |

Column 55-56, Table 14D, under "Sample nos. D1301-1302 add --O--.

under sample nos. D1303-D1306 add --O--.

UNITED STATES PATENT AND TRADEMARK OFFICE

CERTIFICATE OF CORRECTION

PATENT NO. : 4,490,450

DATED : December 25, 1984

INVENTOR(S) : Shimizu et al.

It is certified that error appears in the above-identified patent and that said Letters Patent is hereby corrected as shown below:

under sample nos. D1307-D1310 add --O--.

change ": Excellent

: Good" to

--O: Excellent

O: Good--.

under "Example 32-35" insert --O--.

under "Example 34-37" insert --O--.

under "Example 38-41" insert --O-- and change ": Excellent

: Good" to

--O: Excellent

O: Good--.

Column 57-58 Table 4E, in the "Evaluation" column under "D402" insert --O--, under "D403-D405" insert --O--, and under "D406" insert --O--, before ":Excellent" insert --O--, before ":Good" insert --O--.

UNITED STATES PATENT AND TRADEMARK OFFICE

CERTIFICATE OF CORRECTION

PATENT NO. : 4,490,450

DATED : December 25, 1984

INVENTOR(S) : Shimizu et al.

It is certified that error appears in the above-identified patent and that said Letters Patent is hereby corrected as shown below:

Column 57-58 Table 5E, in the "Evaluation" column under "D501-D502", insert --O--, under "D503-D504" insert --O--, under "D505" insert --O--, before ":Excellent" insert --O-- and before ":Good" insert --O--.

Column 57-58, Table 6E, under the "Gases Employed" column, change "No" to --NO--.

Column 59-60 Table 3F, under the "Gases Employed" column, change "No" to --NO--.

Column 63, line 64, Table 12F, under the "First Layer" column, change "second" to --third--, In column entitled "Evaluation", under "F1101-F1102" insert --O--, under "F1103-F1106" insert --O, under "F1107F1110" insert --O--, also change ":Excellent :Good" to --O: Excellent--

--O: Good--.

UNITED STATES PATENT AND TRADEMARK OFFICE

CERTIFICATE OF CORRECTION

PATENT NO. : 4,490,450

DATED : December 25, 1984

INVENTOR(S) : Shimizu et al.

It is certified that error appears in the above-identified patent and that said Letters Patent is hereby corrected as shown below:

Column 63-64, Table 14F, in the "Evaluation" column, under "F1201 Example 54 and F1202 Example 55" insert --O--, under "F1203-F1206" insert --O--, and under "F1207-F1210" insert --O--, also change :Excellent :Good to --O:Excellent O:Good--.

Column 67, Table 4G, in the "Evaluation" column, insert under "G401-G405" --O--, under "G406-G408" insert --O--, also change ":Excellent" to --O: Excellent O: Good--.

Table 5G, under the "Evaluation" column, insert under "G502" --O--, under "G503-G505" insert --O--, under "G506-G507" insert --O, change ": Excellent : Good" to --O: Excellent O: Good--.

UNITED STATES PATENT AND TRADEMARK OFFICE

CERTIFICATE OF CORRECTION

PATENT NO. : 4,490,450

DATED : December 25, 1984

INVENTOR(S) : Shimizu et al.

It is certified that error appears in the above-identified patent and that said Letters Patent is hereby corrected as shown below:

Column 69-70, Table 9G, in the "Flow Rate" column, under "Second Layer" move "1 x $10^{-5}$" to the "Flow Rate ratio" column.

Column 69-70, Table 11G, under the "Gases Employed" column, for "Third Layer" change "$SiH_4$He=" to --$SiH_4$/He=--.

Column 73-74, Table 15G, under the "Second Layer" column, delete "1 x $10^{-5}$" and insert --1 x $10^{-5}$-- under "Flow rate ratio" column.

Column 79-80, Table 12H, under the "Evaluation" column, insert across the column the following --OOOOOOOO--, and change ":Excellent :Good" to --O:Excellent O:Good--.

Column 79-80, Table 14H, under the "Evaluation" column, insert across the column the following --OOOOOOOOOO--, also change ":Excellent

UNITED STATES PATENT AND TRADEMARK OFFICE

CERTIFICATE OF CORRECTION

PATENT NO. : 4,490,450

DATED : December 25, 1984

INVENTOR(S) : Shimizu et al.

It is certified that error appears in the above-identified patent and that said Letters Patent is hereby corrected as shown below:

:Good" to --O:Excellent

O:Good--.

Column 79-80, Table 16H, under the "Evaluation" column, insert across the column the following --OOOOOOOOOO--, also change ":Excellent :Good" to --O:Excellent O:Good--.

Signed and Sealed this

*Eighth* Day of *October 1985*

[SEAL]

*Attest:*

*Attesting Officer*

DONALD J. QUIGG

*Commissioner of Patents and Trademarks—Designate*